US011268331B2

(12) United States Patent
Barajas Cortes et al.

(10) Patent No.: US 11,268,331 B2
(45) Date of Patent: Mar. 8, 2022

(54) GEAR ROD ROTATOR SYSTEMS

(71) Applicant: Norris Rods, Inc., Tulsa, OK (US)

(72) Inventors: Pablo E. Barajas Cortes, Tulsa, OK (US); Wanru Casey, Tulsa, OK (US); Ramamurthy Narasimhan, Bangalore (IN); Jack Lynn Wallace, South Mounds, OK (US); Juan Felipe Correa Pugliese, Fort Worth, TX (US)

(73) Assignee: NORRIS RODS, INC., Tulsa, OK (US)

( * ) Notice: Subject to any disclaimer, the term of this patent is extended or adjusted under 35 U.S.C. 154(b) by 0 days.

(21) Appl. No.: 15/930,121

(22) Filed: May 12, 2020

(65) Prior Publication Data

US 2020/0340309 A1 Oct. 29, 2020

Related U.S. Application Data

(63) Continuation of application No. 16/288,099, filed on Feb. 28, 2019, now Pat. No. 10,648,246.

(60) Provisional application No. 62/697,784, filed on Jul. 13, 2018.

(51) Int. Cl.

| | |
|---|---|
| ***E21B 17/10*** | (2006.01) |
| ***E21B 47/09*** | (2012.01) |
| ***E21B 47/07*** | (2012.01) |
| ***F04B 47/02*** | (2006.01) |

(52) U.S. Cl.

CPC ..... *E21B 17/1071* (2013.01); *E21B 47/07* (2020.05); *E21B 47/09* (2013.01); *F04B 47/026* (2013.01)

(58) Field of Classification Search

CPC ..... E21B 17/1071; E21B 47/07; E21B 47/09; F04B 47/026

See application file for complete search history.

(56) References Cited

U.S. PATENT DOCUMENTS

| | | | |
|---|---|---|---|
| 3,987,846 | A | 10/1976 | Thompson |
| 4,372,379 | A | 2/1983 | Kuthanek et al. |
| 5,427,178 | A | 6/1995 | Bland |
| 5,628,516 | A | 5/1997 | Grenke |

(Continued)

*Primary Examiner* — Aaron L Lembo

(74) *Attorney, Agent, or Firm* — Phillips Winchester

(57) ABSTRACT

The disclosure is directed to top caps for gear rod rotators and polished clamps. Disclosed top caps include an elongated top cap body extending along a central vertical axis, the top cap body including a top face, a bottom face, and an exterior perimeter surface defining an outer perimeter of the top cap body, and a polished rod opening extending along the central vertical axis of the top cap body, the polished rod opening defining an interior circumferential surface of the top cap body and configured to receive a polished rod. Additionally, disclosed top caps include a nesting region along the top face, the nesting region configured to receive at least a portion of the polished rod clamp, and a mounting rim on the bottom face and extending outwardly from the bottom face along a longitudinal axis of the top cap body, the mounting rim including a mounting rim outer diameter, a mounting rim inner diameter, and a mounting rim bottom face. Disclosed top caps also include a top cap sensor mounting port hole configured to receive a top cap sensor module comprising a sensor including a position sensor, a temperature sensor, and a vibration sensor.

20 Claims, 24 Drawing Sheets

(56) References Cited

U.S. PATENT DOCUMENTS

| | | | | |
|---|---|---|---|---|
| 5,865,245 | A * | 2/1999 | Trout | E21B 33/08 166/84.2 |
| 6,095,241 | A | 8/2000 | Bland et al. | |
| 6,241,016 | B1 | 6/2001 | Dedels | |
| 7,448,444 | B2 | 11/2008 | Thomson et al. | |
| 7,658,225 | B2 | 2/2010 | Joki | |
| 7,857,043 | B2 | 12/2010 | Ali-Zada et al. | |
| 8,016,027 | B2 | 9/2011 | Boyles | |
| 8,403,054 | B2 | 3/2013 | Udipi et al. | |
| 8,550,167 | B2 | 10/2013 | Comeaux et al. | |
| 9,541,073 | B2 | 1/2017 | Rappenecker et al. | |
| 10,125,582 | B1 | 11/2018 | Johnson | |
| 10,167,707 | B2 | 1/2019 | Trapani et al. | |
| 10,240,452 | B2 * | 3/2019 | Robison | E21B 43/127 |
| 10,465,495 | B2 * | 11/2019 | Chavez Rico | G01J 5/0003 |
| 2002/0121367 | A1 | 9/2002 | Meek et al. | |
| 2004/0060371 | A1 | 4/2004 | Barkhoudarian | |
| 2006/0000605 | A1 | 1/2006 | Jordan et al. | |
| 2012/0085552 | A1 | 4/2012 | Travis et al. | |
| 2013/0181844 | A1 | 7/2013 | Hurst et al. | |
| 2013/0269927 | A1 | 10/2013 | Woods | |
| 2014/0116813 | A1 | 5/2014 | Tickner et al. | |
| 2017/0145799 | A1 | 5/2017 | Thomas et al. | |
| 2017/0146007 | A1 * | 5/2017 | Robison | E21B 33/06 |
| 2018/0017623 | A1 | 1/2018 | Zillinger et al. | |
| 2018/0163536 | A1 | 6/2018 | Siefert | |
| 2018/0347319 | A1 | 12/2018 | Feluch et al. | |
| 2019/0063176 | A1 | 2/2019 | Neufeld et al. | |
| 2019/0071956 | A1 | 3/2019 | Ramsey | |
| 2020/0263531 | A1 * | 8/2020 | Fyfe | F04B 47/026 |

* cited by examiner

GEAR ROD ROTATOR SYSTEMS

CROSS-REFERENCE TO RELATED APPLICATIONS

This application is a continuation of U.S. patent application Ser. No. 16/288,099 filed on Feb. 28, 2019 which claims priority to U.S. Provisional Patent Application No. 62/697,784 filed on Jul. 13, 2018. The contents of the above applications are hereby incorporated in their entirety by reference.

FIELD OF THE DISCLOSURE

The present disclosure relates, in some embodiments, to rod rotator systems for positive drive rotating a string of reciprocating sucker rods during the operation of oil pumping equipment for deviated wells in the oil and gas industry.

BACKGROUND OF THE DISCLOSURE

Upon completion of drilling an oil well, fluids from the oil well may be under sufficient innate or natural pressure to allow the oil well to produce on its own. Therefore, crude oil in such wells can rise to the well surface without any assistance. But, even though an oil well can initially produce on its own, natural pressure generally declines as the well ages. In many oil wells, therefore, fluids are artificially lifted to the surface with downhole or subsurface pumps. Sucker rod pump systems are commonly used systems to transport these fluids from downhole oil-bearing zones to the well surface to be collected, refined, and used for various applications.

Typical sucker rod pump systems have a plunger that reciprocates inside a barrel while attached at the end of a string of sucker rods. Reciprocation of the sucker rod string in deviated wells within the sucker rod pump system often leads to uneven frictional wear on the surface of sucker rod pump components such as the sucker rod, tubing, guide, and coupling. Uneven wear of the components leads to costly maintenance and repairs. To counteract this, rod rotators are used to at least partially homogenize frictional wear of the sucker rod pump system components by more evenly distributing frictional wear by slowly rotating the sucker rod or string of sucker rods within the tubing. However, even though rod rotators may prolong the life of sucker rod pump system components, contemporary rod rotators eventually fail to rotate in deviated wells that have high torsional drag due to the excessive contact of the rod string and the tubing and such failures lead to oil well production interruptions.

SUMMARY

Figure 1:
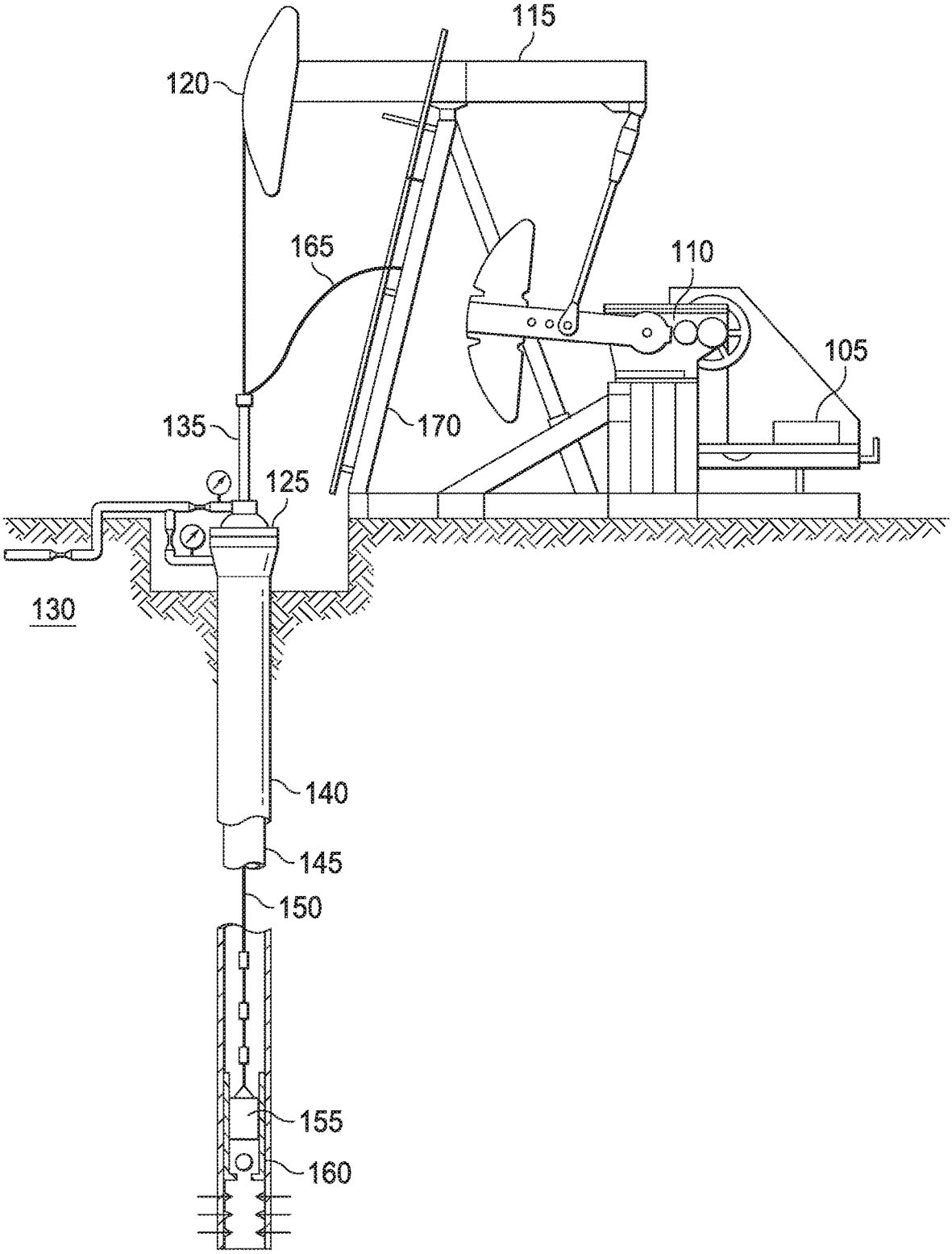
FIG. 1 (PRIOR ART)
FIG. 1 illustrates a general sucker rod pumping system.

The present disclosure relates to gear rod rotator systems. In disclosed embodiments, the present disclosure relates to a top cap for a gear rod rotator, the gear rod rotator connected to a polished rod with a polished rod clamp. The basic components of a top cap include an elongated cylindrical top cap body, a polished rod opening, a nesting region along the top face, and a mounting rim. The top cap body may extend along a central vertical axis of the top cap and can include a top face, a bottom face, and an exterior perimeter surface that defines an outer perimeter of the top cap body. The polished rod opening may extend along the central vertical axis of the of the top cap body and can define an interior circumferential surface of the top cap body. Additionally, the polished rod opening can be configured to receive a polished rod. The nesting region can be configured to receive a portion of the polished rod clamp. The mounting rim can extend outwardly form the bottom face along a longitudinal axis of the top cap body. Additionally, the mounting rim can include mounting rim outer diameter, a mounting rim inner diameter, and a mounting rim bottom face.

Top cap components can have various shapes and sizes. For example, the mounting rim can have an outer diameter ranging from about 1 inch to about 12 inches and an inner diameter ranging from about 0.5 inches to about 11.5 inches. The polished rod opening of the top cap can have a diameter from about 0.5 inches to about 3 inches. The exterior perimeter surface can have a perimeter from about 1 inch to about 12.5 inches.

Disclosed top caps can include nesting regions of various shapes and sizes. For example, the nesting region can include a lock-in inset region. The lock-in inset region can have a rectangular cross-section extending along the top face of the top cap. The lock-in inset region can have a depth from about 0.1 inches to about 24 inches and a width from about 0.5 inches to about 12 inches. The lock-in inset region can be a v-shaped inset region, beginning at one edge of the exterior perimeter surface and extending along the longitudinal axis from about 60% to about 95% of the top face. Additionally, the lock-in inset region can have a shape including a diamond, a curvilinear shape, a polyhedron, a circle, an oval, a square, a rectangle, a c-shape inset, a pentagon, a hexagon, a triangle, and a curvilinear triangle.

Described nesting regions include a locking fixture. Disclosed locking fixtures can have various shapes and sizes. For example, locking fixtures can include a shape selected from the group consisting of a diamond, a curvilinear shape, a polyhedron, a circle, an oval, a c-shape inset, a square, a rectangle, a pentagon, a hexagon, a triangle, and a curvilinear triangle. The locking fixture can include a plurality of fasteners configured to nest the polished rod clamp at its perimeter interfacing with the top face of the top cap body.

Disclosed gear rod rotator systems include top caps as described above. Additionally, gear rod rotator systems include a central housing having a generally hollow first annular tube along a central vertical axis and a generally hollow second annular tube along a longitudinal axis. In some embodiments, gear rod rotator systems also include a ratchet mechanism and a top cap rotating mechanism. Ratchet mechanism can be received within the second annular tube and include an actuator lever, an actuator end cap, a worm drive shaft key, a one-way clutch bearing key, a one-way clutch bearing for the actuator lever, and a worm drive shaft. The ratchet mechanism can include a locking bolt. The top cap rotating mechanism can be received within the first annular tube and can be configured to drive rotation of a top cap, the top cap rotating mechanism comprising a rod load bearing and a worm gear. The gear rod rotator system can have a linkage configured to connect the top cap to the top cap rotating mechanism. The linkage can be placed in a recess on the mounting rim bottom face of the top cap, the recess having a depth from about 0.01 inches to about 6 inches.

Described top caps include top cap sensor mounting port holes configured to receive a top cap sensor module. The top cap sensor module includes a power supply, a sensor module transmitter, and a sensor such as a position sensor, a temperature sensor, and a vibration sensor. Top cap sensor modules can have location-determining systems such as a Global Positioning System (GPS)-based system.

In some embodiments, the present disclosure relates to systems for determining statuses for reciprocating rods. Disclosed systems include a computer processor operational to receive signals from a sensor and a top cap configured to engage the reciprocating rod, the top cap including a top cap sensor mounting port hole, the top cap sensor mounting port hole configured to receive a top cap sensor module. Top cap sensor modules include the sensor operable to receive feedback from the reciprocating rod, a power supply, and a sensor module transmitter configured to send the signal from the sensor. The computer processor can include a cloud based controlling system, a programmable logic controller, a feedback control system, an on-off control system, a linear control system, a fuzzy logic control system, a programmable processing unit, a memory, a random-access memory, a network interface controller, a motherboard, an input device, and an output device, wherein the processor is configured to monitor and control the system for extracting the organic compound from the natural source.

The present disclosure relates to methods for determining statuses of reciprocating rods. Disclosed methods include the steps of receiving feedback at a sensor from the reciprocating rod, constructing a signal from the feedback received at the sensor, transmitting the signal from the sensor to a computer processor, and generating display signals, operable to be received by a visual display. In some embodiments, a top cap may be configured to engage the reciprocating rod.

DETAILED DESCRIPTION

The present disclosure relates, in some embodiments, to gear rod systems used in a reciprocating sucker rod pumping systems that transport oil from oil wells. Disclosed sucker rod pumping systems function on the positive displacement principle used by cylinder and piston pumps. FIG. 1 illustrates the basic components of a sucker rod pumping system. As shown in FIG. 1, the basic sucker rod pumping system components include a motor base 105, a gearbox 110, a walking beam 115, a horsehead 120, a wellhead 125, a flowline 130, a polished rod 135, a casing 140, a tubing 145, a rod string 150, a plunger 155, cable 165, Samson beam 170, and a barrel 160.

The motor base 105 provides the driving power to the system and can be an electric motor or a gas engine. The gear box 110 reduces the high rotational speed of the motor base 105 into the reciprocating motion required to operate the downhole pump. The main element of the gear box 110, the walking beam 115, functions as a mechanical lever that adjusts the position of the horsehead 120 that is connected to the polished rod 135. The Samson beam 170 serves as a vertical stabilizing leg to hold up the horsehead 120 and the walking beam 115. The Samson beam 170 can be connected through a cable 165 to the polished rod. The horse head 120 translates the rotational motion from the motor base 105 into the reciprocating motion of the polished rod 135, which reciprocates through the wellhead 125 and into the oil well. At the end of the polished rod 135 or a string of sucker rods is the plunger 155 that is the main mechanical driver of fluid out of the oil well. Around the polished rod 135 and within the oil well is a casing 140 that surrounds tubing 145. Together, the casing 140 and tubing 145 form a casing-tubing annulus that that surrounds rest of the sub-surface pump system components. Sucker rod string 150, composed of sucker rods, runs inside the tubing string of the well and provides the mechanical link between the surface drive and the subsurface pump. The pump barrel 160 or working barrel is the stationary part of the subsurface pump that serves as a stopping point for the plunger 155. The barrel 160 generally contains a standing valve that acts together with the plunger 155 as a suction valve through which well fluids enter the pump barrel during an upstroke.

Figure 2:
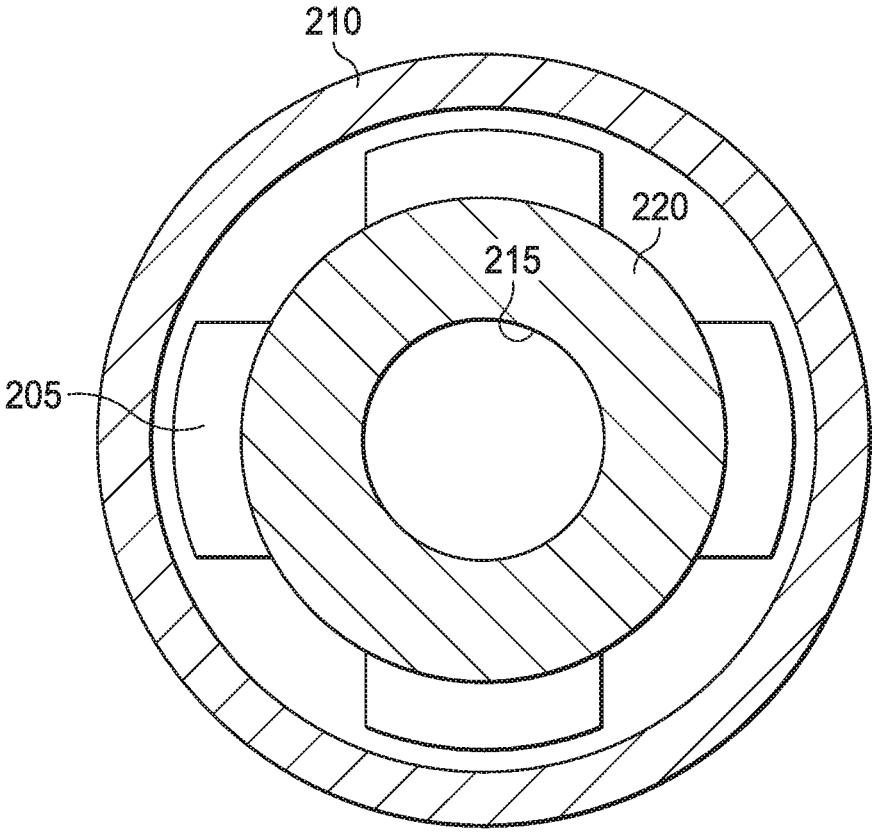
FIG. 2 (PRIOR ART)
FIG. 2 illustrates a cross-sectional view of a general sucker rod guide system.

Drilled wells are often not completely vertical. Therefore, as the sucker rod string 150 reciprocates within the uneven well, the sucker rod string 150 is asymmetrically worn through rod-on-tubing friction. This friction can increase in cases with crooked wells, cases with fluid or gas overpressurization, and situations where there is tubing or rod buckling. To help minimize this uneven wear, rod guides are generally used in sucker rod pumping systems. FIG. 2 illustrates a cross-sectional view of a general rod guide system. As shown in FIG. 2, a rod guide system includes a rod guide 205, tubing 210, a sucker rod 215, and a coupling 220. Rod guides 205 are usually made of a polymer, but can be made from metal as well. The rod guides 205 can be attached to the sucker rod 215 at multiple depths depending on the shape of the well. The sucker rod 215 is contained within the coupling 220, which is contained within the tubing 210. Rod guides 205 maintain separation between the coupling 220 or the rod 215 and the tubing 210. In general, the rod guides 205 maintain a substantially even distribution of the position of the coupling 220 and sucker rod 215 within the tubing 210 and balances out the wear on the components. However, once the rod guides wear, uneven wear takes place again.

Figure 3:
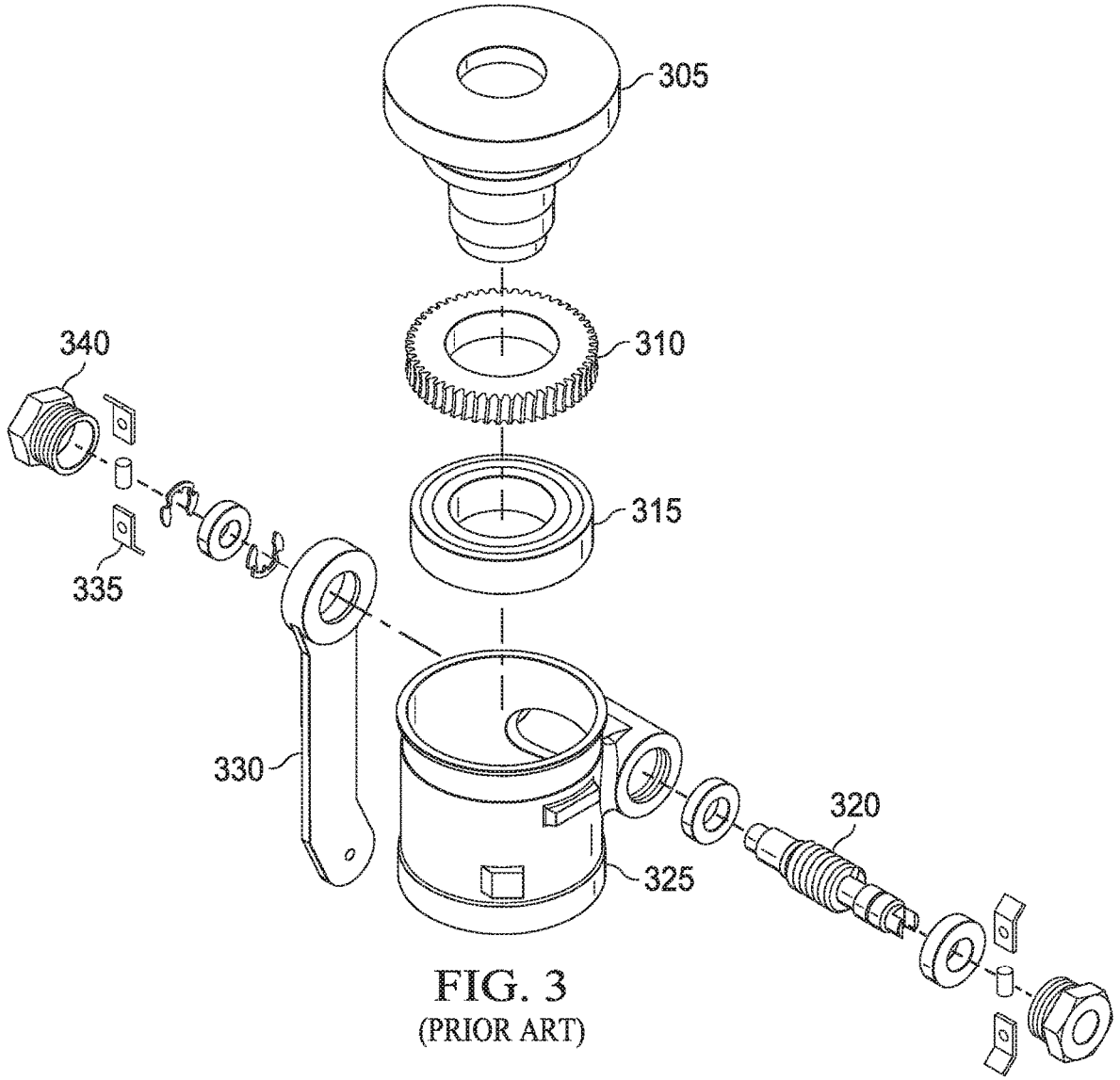
FIG. 3 (PRIOR ART)
FIG. 3 illustrates an exploded view of the components of a general rod rotator system.

In addition to using rod guides, another tactic to reduce wear is to gradually rotate the polished rod and rod string themselves to balance the wear on the rod guides to substantially increase their operating life. FIG. 3 illustrates a general rod rotator. As shown in FIG. 3, a rod rotator generally includes a top cap 305, a worm gear 310, a rod load bearing 315, a worm drive shaft 320, a rotator system body 325, an actuator lever 330, j-hook ratchet 335, and a ratchet body 340. Rod rotators are generally installed above-surface and at the bottom of the polished rod. The actuator lever 330 is generally attached to the base of a horsehead. As the motor base cycles and the horsehead moves up and down, the reciprocating motion of the horse head translates to the actuator lever 330. The ratchet body 340 and j-hook ratchet 335 permit the actuator lever to reset position without constantly affecting the position of the attached sucker rod string. The rotator system housing 325 encloses the rod rotator components. The worm gear 310 coupled with the rod load bearing 315 and the worm drive shaft 320 translates the ratcheting motion from the actuator lever 340 into rotational motion of the top cap 305. The top cap 305 is generally contacted by polished rod clamps that are clamped onto the polished rod connected sucker rod string. In general, rotational motion is translated from the top cap 305 to the sucker rod string through polished rod clamps through friction between the top cap 305 and the polished rod clamp. However, rod rotator systems that predominantly rely on friction force between the top cap and polished rod clamps may limit the torque that can be transmitted to the string of sucker rods.

General rod rotators and disclosed rod rotators can be made from various materials such as metal or polymers. Top caps are generally made of steel or steel alloys. Worm gears and worm drives are also generally made from steel or alloys thereof.

Figure 4A:
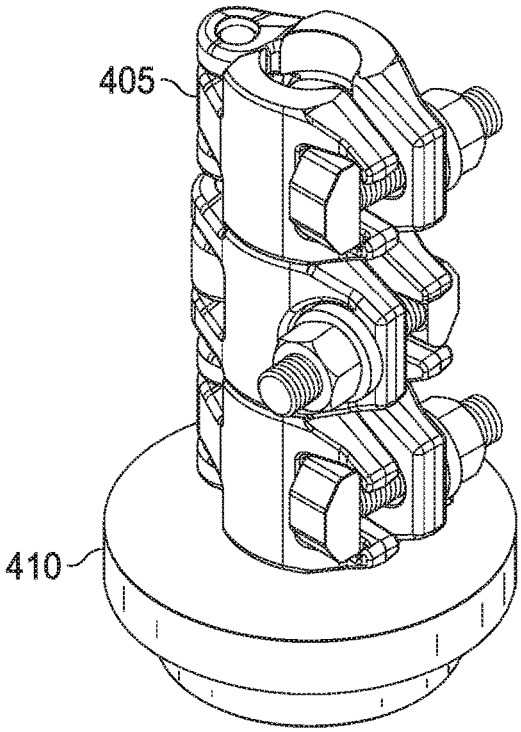
FIG. 4A (PRIOR ART)
FIG. 4A illustrates an isometric view of a prior art polished rod clamp engaging a top cap not having a nesting region.
Figure 4B:
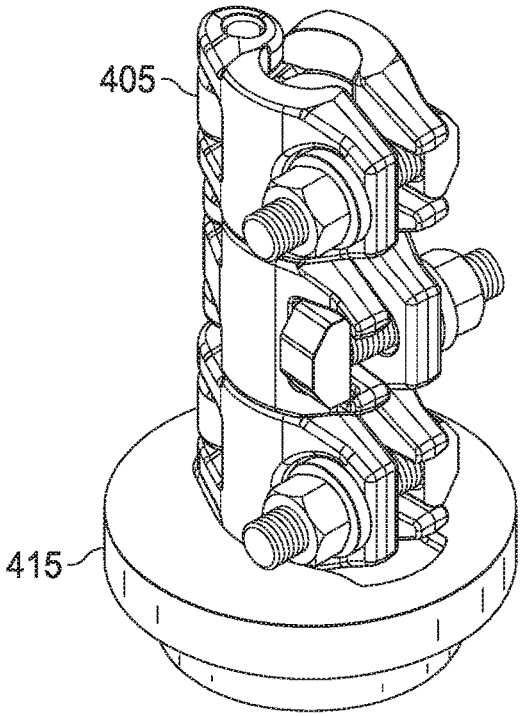
FIG. 4B illustrates an isometric view of the polished rod clamp engaging a top cap having a fitted nesting region according to a specific example embodiment of the disclosure.
Figure 4C:
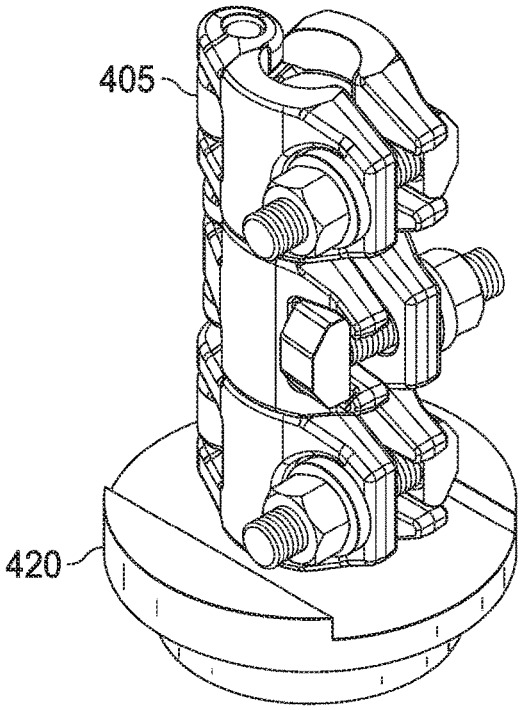
FIG. 4C illustrates an isometric view of a polished rod clamp engaging a top cap having a nesting region with a rectangular cross-section according to a specific example embodiment of the disclosure.
Figure 4D:
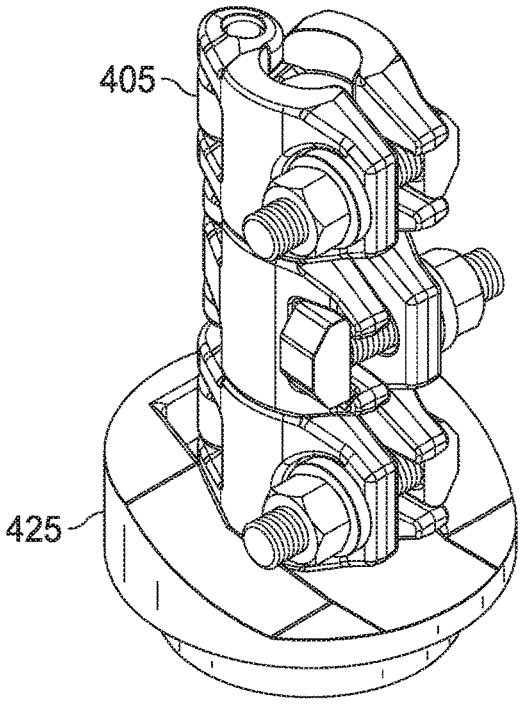
FIG. 4D illustrates an isometric view of a polished rod clamp engaging a top cap with a v-shaped inset region according to a specific example embodiment of the disclosure.
Figure 4E:
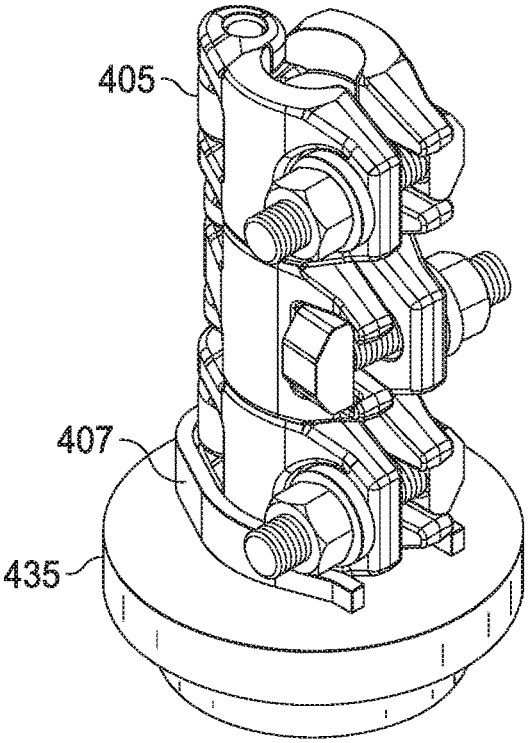
FIG. 4E illustrates an isometric view of a polished rod clamp engaging a top cap having a locking fixture according to a specific example embodiment of the disclosure.
Figure 4G:
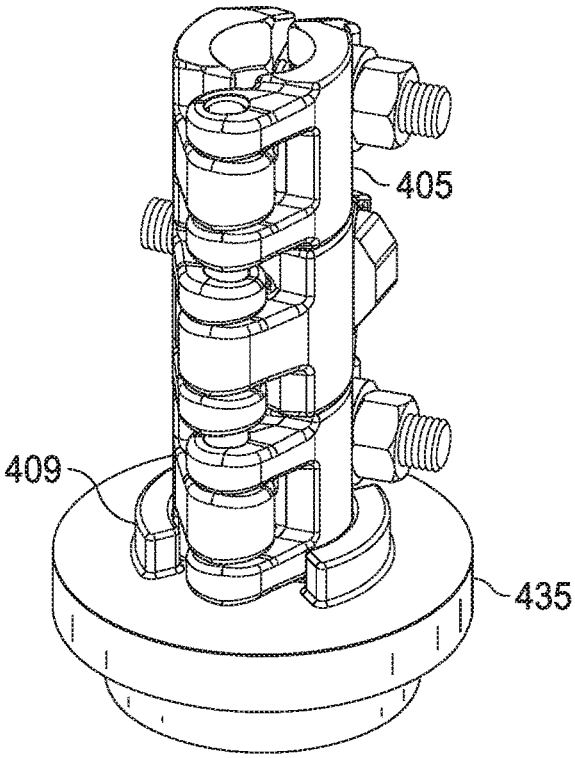
FIG. 4G illustrates an isometric view of a polished rod clamp engaging a top cap having a locking fixture that holds a cylinder section of the polished rod clamp according to specific example embodiment of the disclosure.
Figure 4F:
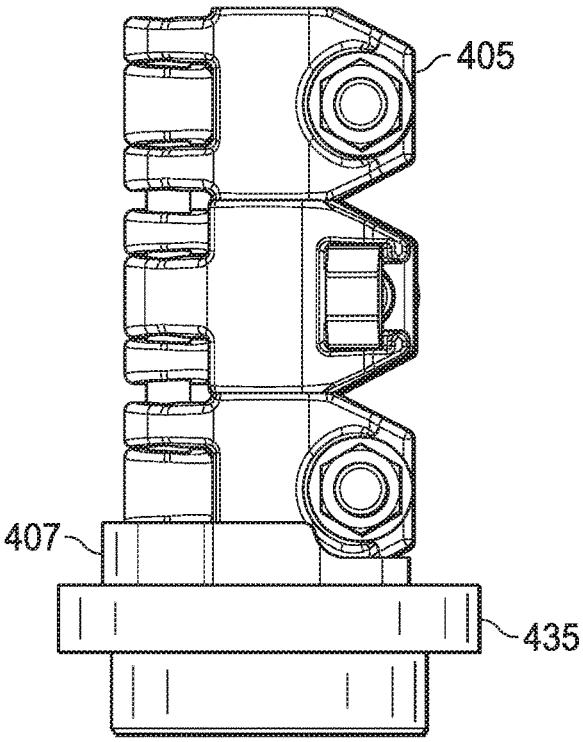
FIG. 4F illustrates a side view of the polished rod clamp from FIGURE E where the top cap has a locking fixture according to a specific example embodiment of the disclosure.

FIGS. 4A-4G illustrate isometric views of polished rod clamps engaging with various top cap configurations. FIG. 4A illustrates polished rod clamp 405 engaging top cap 410 that is flat on top and does not having a nesting region. This configuration predominantly relies on friction force between the top cap and a polished rod clamp to transmit rotational energy from the rod rotator to the sucker rod string. The present disclosure relates to various configurations of rod rotators having top caps with a nesting region that functions as a polished rod clamp locking system, as shown in FIGS. 4B-4G. Nesting regions include lock-in inset regions and locking fixtures. Disclosed rod rotators may include locking fixtures 407, 409 that function as a polished rod clamp locking system as shown in FIGS. 4E-4G. Locking fixtures may be raised fixtures with respect to the top cap.

FIG. 4B illustrates an isometric view of polished rod clamps 405 engaging top cap 415 with a lock-in inset that is substantially the cross-sectional shape of the polished rod clamp. This configuration not only includes frictional force between the top face of the top cap and the bottom face of the polished rod clamp, but also includes additional frictional and pushing force between the inner side walls of the inset region and the side walls of the polished rod clamp. Lock-in insets may include any shape including a diamond, a curvilinear shape, a polyhedron, a c-shape inset, a circle, an oval, a square, a rectangle, a pentagon, a hexagon, a triangle, and a curvilinear triangle. FIG. 4C shows polished rod clamps 405 engaging top cap 420 that has a nesting region having a rectangular cross-section. Disclosed top caps having nesting regions 420 with rectangular cross-sections such as the one depicted in FIG. 4C can desirably fit polished rod clamps 405 of various shapes and sizes as the lowest polished rod clamp only needs to be small enough to seat into the inset region. FIG. 4D illustrates an isometric view of a polished rod clamp 405 engaging a top cap 425 having a substantially v-shaped inset or a v-shaped profile. FIGS. 4E-4G illustrate isometric views of polished rod clamps 405 engaging top caps 425 having locking fixtures 407, 409. Locking fixtures may be raised fixtures with respect to the top cap. Locking fixtures include any shape comprising a diamond, a curvilinear shape, a polyhedron, a c-shape inset, a circle, an oval, a square, a rectangle, a pentagon, a hexagon, a triangle, and a curvilinear triangle. In some embodiments, a locking fixture can have a height from about 0.1 inches to about 24 inches and a width from about 0.5 inches to 12 about inches.

Gear rod systems having lock-in inset regions and locking fixtures 407, 409 that engage polished rod clamps as disclosed herein provide a more effective transmission of torque and rotation from the rod clamp, and a shear pin communicating the top cap with the worm gear set, to the gear rod system in comparison to a corresponding gear rod system having a top cap without a nesting region or having a flat top cap. For example, the gear rod systems having nesting regions including the lock-in inset regions or the locking fixtures 407, 409 such as shown in FIG. 4B-4G provide at least about four times the output torque to the string of sucker rods in comparison to the gear rod system may provide for as much torque as the top cap of the gear rod system may endure, which may create a torsional failure on the sucker rod or string of sucker rods without the nesting region.

A general gear rod system with a top cap that does not have a nesting region can transmit from about 160 foot/pounds (ft./lbs.) to about 240 ft./lbs. of torsional drag between the top cap and the polished rod clamps at the end of a downstroke. This can become problematic if this same gear rod system is installed in a highly deviated well or if downhole conditions change to high torsional drag because the rod clamp would slip off of the top cap or the top cap would slip off internally of the top of the worm gear and fail to continue to evenly distribute wear on the sucker rod string. In disclosed gear rod systems having the described nesting regions such as lock-in inset regions and locking fixtures 407, 409, the top plate may drive the string of sucker rods to a torque of at least about 1219 ft./lbs. so that it operates smoothly in highly deviated wells or high torsional drag downhole conditions. In general, the torsional requirements so that the sucker rod string is constantly rotated in deviated wells and highly deviated wells in progressive cavity pumping applications are about 800 ft./lbs. or more. Disclosed gear rod systems are configured to rotate sucker rod strings at a rate from about 0.5° to about 2° of rotation per lever pull. For example, the rod rotator can rotate the sucker rod string at a rate from about 0.8° to about 1.6° of rotation per lever pull. However, rotation rates of less than about 0.5° or greater than about 2° can be achieved adjusted by adjusting component parameters including worm gear/worm drive gear ratios, actuator arm lengths, and top cap nesting region shapes and sizes.

Top caps as disclosed in this application can be made of any metal or composite. For example, metals include carbon steel, high carbon steel, low carbon steel, stainless steel, zinc plated clear steel, zinc plated yellow steel, galvanized steel, copper, brass, tungsten, chromium, titanium, steel-iron-nickel alloy, tungsten carbide, titanium aluminide, and iron. Alloys of each metal can be blended for desired tensile strength, compressive strength, yield strength, and impact strength. Top caps can be painted to any color or coated with substances to increase or decrease friction. For example, the top cap can be coated with an anti-friction coating having solid lubricant components including molybdenum disulphide, graphite and polytetrafluoroethylene. Additionally, the top cap can be coated with a high-friction coating including electroless nickel that is co-deposited with silicon carbide.

Disclosed top caps can be any shape and size. As shown in FIGS. 4A-4G, top caps can have a generally cylindrical shape, but can also have a polygonal top face. Additionally, nesting regions are not limited to the shapes shown in FIGS. 4B-4G, but can have any number of sides or walls. Nesting regions can be any depth depending on the application. For example, a nesting region, such as a lock-in inset region, can have a depth from about 0.1 inches to about 24 inches. FIGS. 4B-4D depict nesting regions comprising inset regions contacting the lowest polished rod clamp. However, disclosed inset regions can be of enough depth to contact or engage multiple polished rod clamps. FIGS. 4E-4G depict nesting regions including locking fixtures 407, 409 contacting the lowest polished rod clamp. Locking fixtures 407 can be any height depending on the application. For example, a locking fixture 407 can have a height from about 0.1 inches to about 24 inches. However, disclosed locking fixtures 407 can be of enough height to contact or engage multiple polished rod clamps.

Figure 5A:
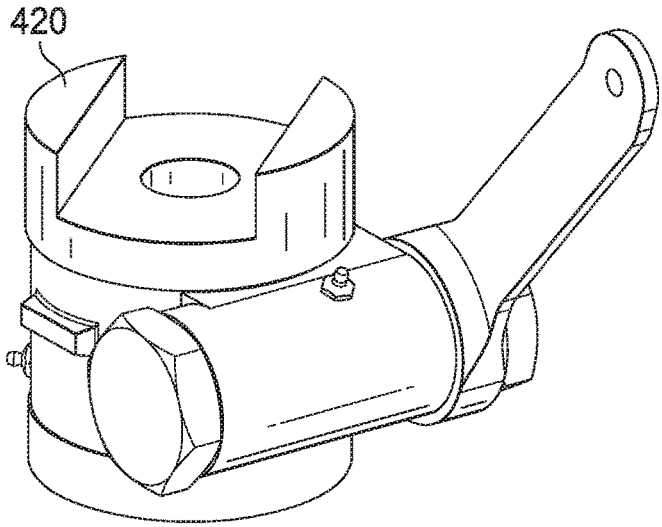
FIG. 5A illustrates an isometric view of a gear rod rotator system having a top cap with a nesting region having a rectangular cross-section according to a specific example embodiment of the disclosure.
Figure 5C:
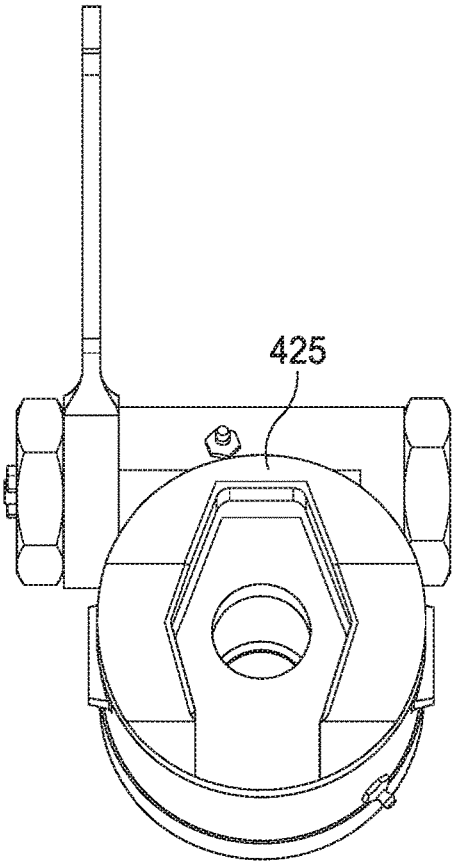
FIG. 5C illustrates a top view of a gear rod rotator system having a top cap with a v-shaped insert region according to a specific example embodiment of the disclosure.
Figure 5B:
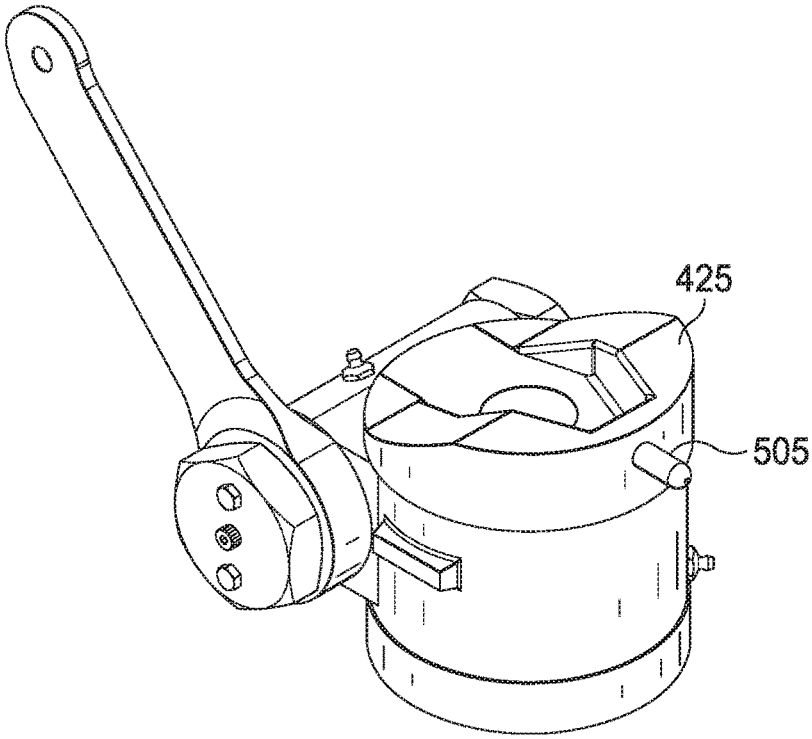
FIG. 5B illustrates an isometric view of a gear rod rotator system having a top cap with a v-shaped inset region and having a top cap sensor module visible according to a specific example embodiment of the disclosure.

FIGS. 5A-5C highlight the two different top cap configurations shown in FIGS. 4C and 4D with the polished rod clamps 405 removed from view. As shown in FIG. 5A, disclosed gear rod rotator systems include top caps with nesting regions having substantially rectangular or square cross-sections. Disclosed rod rotator systems can also have nesting regions that are substantially v-shaped, as shown in FIG. 5B. Additionally, the present disclosure relates to top cap configurations having sensor module 505, allowing a user to derive real-time data from the top cap, including temperature, pressure, position, vibration data, revolutions per minute (RPM) detection, and combinations of each type of data. Any type of disclosed top cap can be configured to have one or more top cap sensor modules 505, including top caps with both v-shaped inset regions and those with substantially rectangular cross-sections. Aggregation of data from multiple top cap sensor modules 505, as disclosed in this application, provides the user with a multi-dimensional analysis of down well function and component conditions, top cap integrity, and gear rod rotator statuses that may not be obtainable through single top cap sensor systems or systems with no top cap sensor modules. Therefore, users of the gear rod rotator systems described in this application can perform simultaneous multi-dimensional analyses of multiple components of the systems by aggregating and analyzing data from a series of top caps having one or more top cap sensor module 505 or from a single top cap having one or more top cap sensor modules 505. The monitoring systems described in the present application should be understood to be usable in the context of any or all of these locations or in other locations. Monitoring systems can include a location determining system for determining network location information or physical location information associated with at least one of the top cap sensor module or the top cap.

Additionally, other components of disclosed gear rod rotating systems may be configured to contain sensor modules, not just the top cap. For example, a worm gear or actuator lever can be configured to have sensor modules.

Besides real-time data, the top cap sensor module 505 can derive, aggregate, compute, and transmit accumulated data over the life time of the gear rod rotator system. Accumulated data can entail accumulated temperature, accumulated vibration of sucker rod strings, and accumulated total number of top cap position actuations or changes. The data can then be transmitted by a gateway to be monitored by a user interface, and the analysis of the gear rod rotator system components can be performed as they tend towards failure, full on failure, or degraded performance.

Disclosed top cap sensor modules 505 include a power supply, a position sensor, a temperature sensor, a vibration sensor, and a sensor module transmitter. Real-time analysis of data received from the sensor module transmitter, and interaction through a user interface desirably provides a user with status updates and provides for predictive measures of component failure and system downtime. Being able to analyze trends in measured information relative to component failure of gear rod rotator, sucker rod string, pump performance, gear rod rotator system performance, and system downtime may help avert system downtime and mitigate other system performance issues. Additionally, disclosed systems for gear rod rotator system monitoring described in this application may be installed before or after top cap or gear rod rotator system assembly, permitting data analysis at any time during the lifetime of the monitored system.

The systems described in this application provide for a synergistic effect that is found through aggregation of top cap sensor module 505 data and providing for cloud-based transmission aggregation and analysis. For example, when examining the aggregation of data provided by a position sensor and a vibration sensor, the combined sensor data may permit a user and/or an automated analysis program to determine if a sucker rod string has developed is overly worn, has developed any catastrophic damage, or if components of the system need to be replaced. Unless you are physically observing down well components, the wear and component damage would not be otherwise observable. The top cap sensor data permits an observation of the gear rod rotator becoming inefficient at rotating the polished or the polished rod being damaged without the need to actually remove and inspect the polished rod.

In disclosed embodiments, a top cap sensor module 505 can include a power supply such as a battery, a general electricity power line, a photovoltaic cell, and combinations thereof. The battery can be recharged or replaced. For example, the battery may be rechargeable via photovoltaic systems or by general electricity driven charging stations. Battery life in these embodiments may be from about six months to about two years without being recharged or replaced. Disclosed remote power supply options permit top cap sensor modules 505 to operate by communicating data from remote to a central location with limited maintenance required to maintain operation. Disclosed batteries include chargeable and non-rechargeable lithium primary cells, alkaline cells, rechargeable nickel-cadmium, nickel-metal hydride, and other types of cells existing now or developed in the future that would be appropriate for the designed embodiments.

Position sensors described in this application detect the current position of the top cap relative to a zero-point position, such as a starting or ending point. Positions such as a can change due to reductions in friction forces between the top cap and the polished rod clamp due to wear of the top cap. For example, if a staring position of a new top cap is at a 0% position, over time the initial position or position after a set number of rod rotations may change to −1%, −3%, or −5%, which depending on gear rod system design may in one of the changed positions indicate that the top cap should replaced, worm gear should be replaced, shear pin be replaced, or the polished rod clamp should be tightened with sucker rod string or top cap itself. Disclosed position sensors can be used not only with top caps, but could be used on actuator levers, worm gears, and worm drives. The position sensor of the disclosed embodiments could further be used to log movements to determine how many times a top cap has rotated a set angle, such as 360°.

Disclosed temperature sensors include a thermocouple, a negative temperature coefficient (NTC) thermistor, a resistance temperature detector (RTD), and a semiconductor-based sensor. Temperature sensors of the disclosed embodiments can detect temperatures of a top cap, temperatures inside the gear rod rotator system, polished rod clamps, and combinations thereof. Correlating body temperatures of the top cap to that of the sucker rod string allows for non-invasive temperature measurement. Temperature measurements of the top caps described in this application can be used to monitor and regulate not only the temperature of the top cap itself, but of the fluid or gas flowing within the string of sucker rods. Temperature measurement data permits users to assess the activity of the fluid or gas inside the sucker rod string. For example, temperature measurements in excess of the top cap set temperature rating correlate with a break down sucker rod strings due to excess torque or pressure from the deviated well.

Disclosed top cap sensor modules 505 having both pressure sensors and temperature sensors could communicate leakage or down well break down events to users that may not be apparent without sensors. Aggregation of chronological data, both at an individual module level, at a singular installation level, or across gear rod rotator systems and even separate well bores, can permit users and/or an automated control and monitoring system, to assess trends to failure such as overheating or overpressurization of disclosed gear rod rotator systems. Users of the disclosed systems can therefore determine overheating and degradation of both the gear rod rotator systems and the sucker rod strings.

Disclosed vibration sensors or accelerometers measure vibration of top caps. The vibration measured may be derived from vibration of sucker rod string and gear rod rotators. Vibration sensors couple with temperature sensors to read the temperature of the top plate and signal for dry running of gear rod rotators. Described vibration sensors read the direct vibration of gear rod rotator motion and reaction forces of sucker rod weight and interaction with deviated wells. Vibration data includes magnitude, frequency, and duration of vibration.

Disclosed top cap sensors permit users to identify if a gear rod rotation system is operating properly and can be used in methods for determining the status of reciprocating sucker rods and gear rod rotation systems. Alarms can be set to permit users to act on information that may lead to an increase in the lifetime of the sucker rod string or gear rod rotator. For example, if top cap sensor module 505 is rated for about 100° C., then the temperature threshold alarm status can alert the user when the top cap reaches a temperature of about 90° C., allowing users to perform adjustments to prevent temperature or torque overloads.

Top cap sensor modules can be mounted to the top plate at various angles. For example, a top cap sensor module 505 can be mounted to the top plate at an about 45° angle with respect to side of the top plate. Additionally, top cap sensors can be mounted at any angle from about 1° to about 179° from a central vertical axis. Top cap sensor modules can be any shape or size. For example, top cap sensor modules can be from 0.1 inch to about 6 inches. Sensors within the top cap sensor modules can be placed at any position of the top cap sensor module either proximal or distal to the top cap, which can synergistically enhance data collection. For example, if a vibration sensor is placed distal to the top cap gear rotary vibration is magnified due to the cantilever mount of the vibration sensor from the vibration epicenter or source. This may help detect and analyze lower amplitude vibrations received from the deviated well.

Figure 6A:
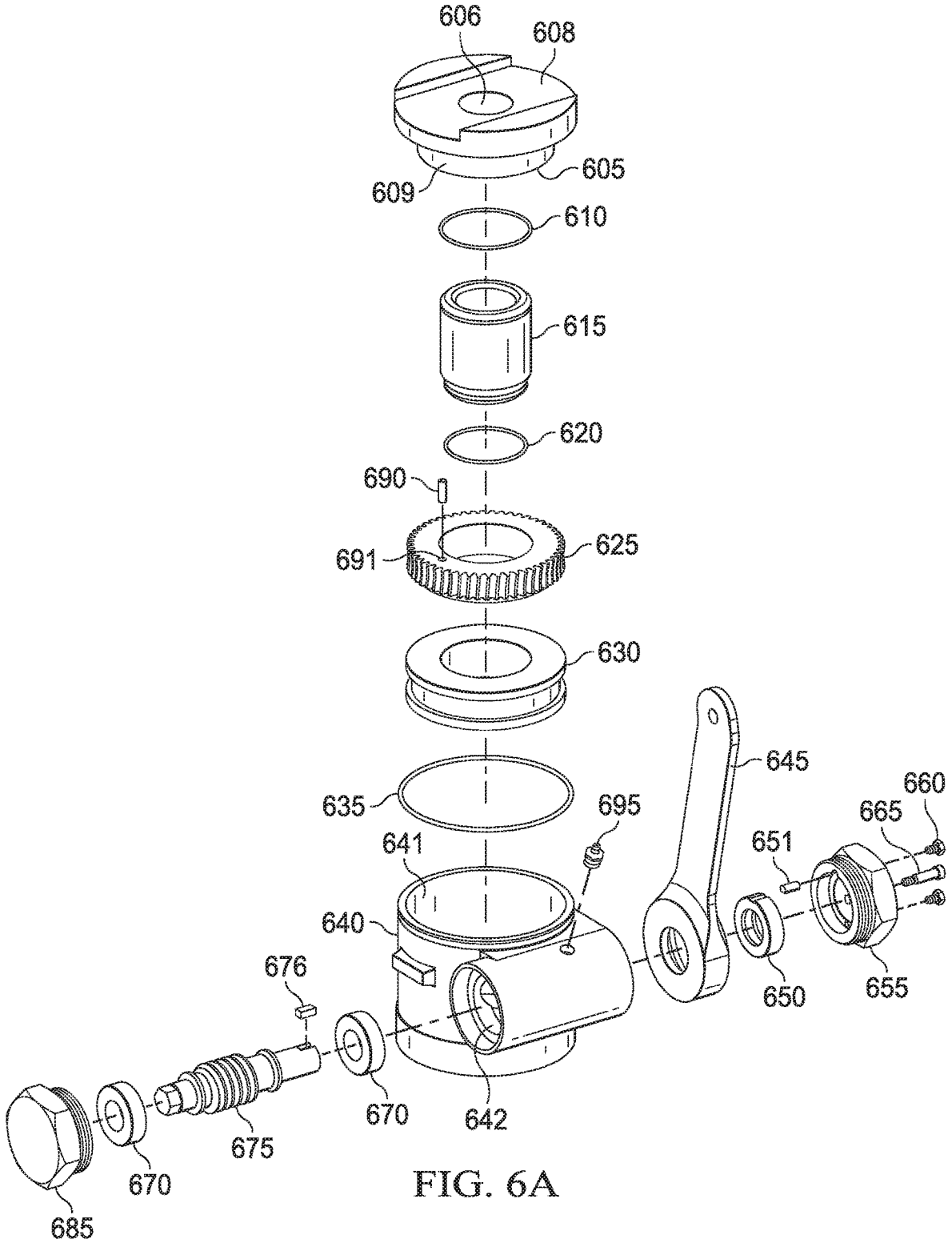
FIG. 6A illustrates an exploded view of a gear rod rotator system having a top cap with nesting region having a rectangular cross-section according to a specific example embodiment of the disclosure.
Figure 6B:
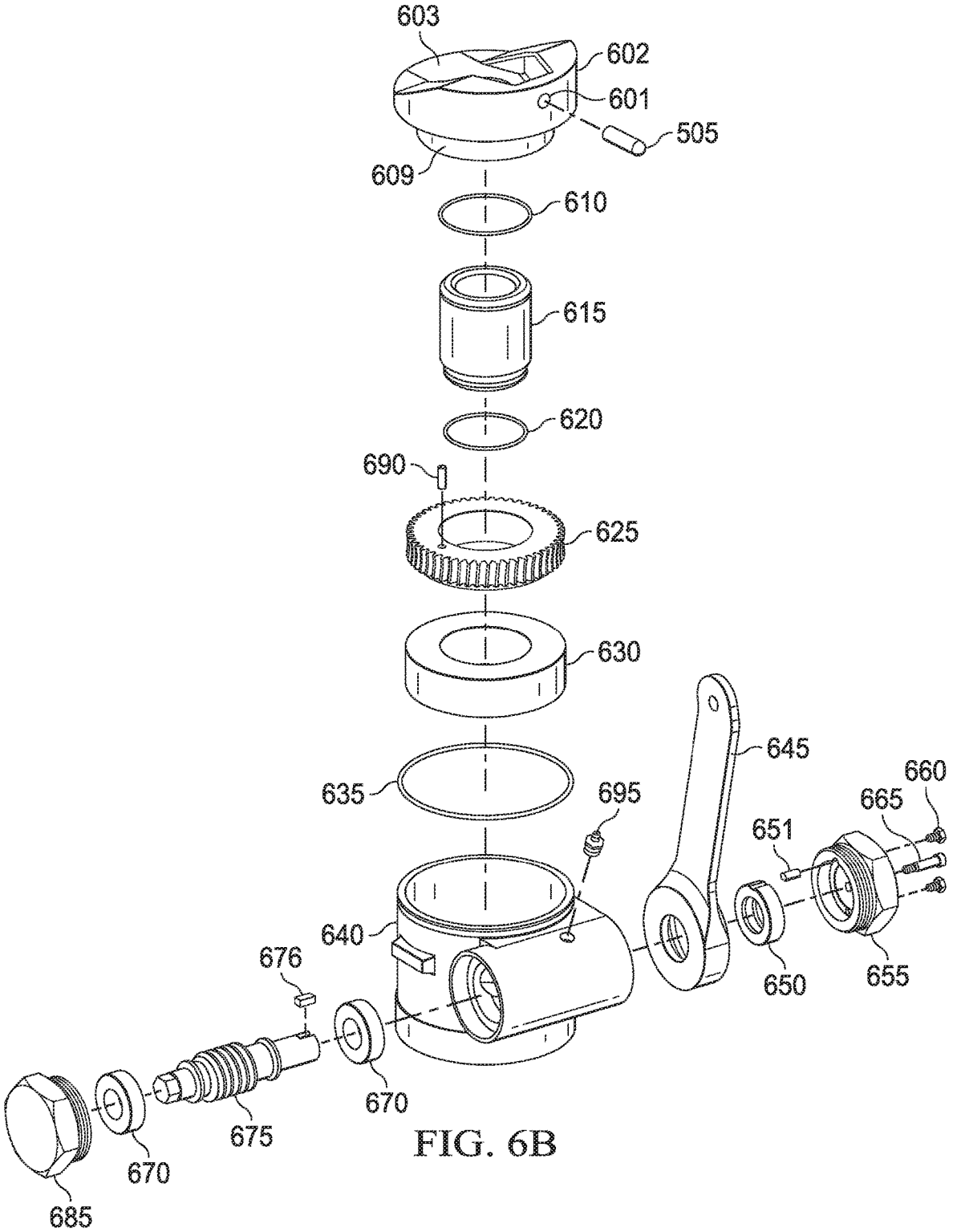
FIG. 6B illustrates an exploded view of a gear rod rotator system having a top cap with an v-shaped inset region and a top cap sensor according to a specific example embodiment of the disclosure.

FIGS. 6A-6B illustrate an exploded view of a gear rod rotator system according to a specific example embodiment of the disclosure. As shown in FIG. 6A, a gear rod rotator system includes a top cap 605 having an nesting region 608 and a polished rod opening 606, O-rings 610, 620, 635, a sleeve centralizer 615, a worm gear 625, a rod load bearing 630, a shear pin 690, a locking bolt 665, an actuator lever end cap 655, two service bolts 660, a one-way clutch bearing key 651, a one-way clutch bearing for the actuator lever 650, an actuator lever 645, two bearings 670, which may provide shaft support, a worm drive shaft 675, a worm drive shaft key 676, a protective end cap 685, two grease nipples 695, and a gear rod rotator system housing 640. As shown in FIG. 6A, a top cap 605 includes a generally cylindrical body with an outer diameter, the body defining a hollow interior or polished rod opening 606. Top cap 605 has a top face having a nesting region 608, the nesting region 608 having a rectangular cross-section. Disclosed top cap 605 includes a bottom face with a circular mounting rim 609, the circular mounting rim 609 having an outer diameter of less than the outer diameter of the body, with the circular mounting rim 609 configured to receive O-ring 610 and a top portion of the sleeve centralizer 615. The bottom face of top cap 605 has a recess configured to receive a top portion of the shear pin 690, the bottom portion of the shear pin 690 being received by a corresponding recess 691 on a top face of worm gear 625. Shear pin 690 is a substantially hollow cylinder with an inside diameter, an outside diameter, a top portion, a bottom portion, and a separation along the annular wall extending from the top portion to the bottom portion. In place of the shear pin 690, any linkage can connect the top face of worm gear 625 to the bottom face of top cap 605. Worm gear 625 includes teeth that are configured to fit into or mesh with the grooves or teeth of the worm drive shaft 675. Rod load bearing 630 is configured to support the bottom portion of worm gear 625 and to receive O-ring 620 and the bottom portion of sleeve centralizer 615. Gear rod rotator system housing 640 is a substantially hollow cylinder defining both a longitudinal hollow cylinder 641 and a sagittal hollow cylinder 642. Longitudinal hollow cylinder 641 is configured to contain O-rings 610, 620, 635, sleeve centralizer 615, worm gear 625, rod load bearing 630, and circular mounting rim 609 while providing annular support of top cap 605 by contacting the bottom face of the top cap 605. Sagittal hollow cylinder 642 is configured to contain two bearings 670, and worm drive shaft 675. Through a common port hole in the sagittal hollow cylinder 642 and the longitudinal hollow cylinder 641, the worm drive shaft 675 and worm gear 625 fits into or meshes with each other. Worm drive shaft 675 is held into place in the sagittal hollow cylinder 642 by a protective end cap nut 685, two bearings 670, one-way clutch bearing for the actuator lever 650, two service bolts 660, an actuator lever 645, and a locking bolt 665. Actuator lever 645 is configured to engage the one-way clutch bearing, the worm drive shaft 675, and the worm drive shaft key 676 so that the worm drive shaft 675 is driven to rotate one way in a ratchet-like motion. Disclosed one-way clutch bearing for the actuator lever 650 can be contained in the actuator lever end cap 655 and can contain the one-way clutch bearing key 651. Bearings 670 include, but are not limited to, rotary bearings such as thrust bearings, ball bearings, plain bearings, fluid bearings, magnetic bearings, and flexure bearings. Bearings 670 can be chosen depending on operating situations and forces including radial, axial, or bending moment forces. For example, a gear rod rotator system can include thrust bearings in operating situations where the bearing endures an axial load under high torque drag. Employing a thrust bearing in such an operating situation may provide for have a greater service cycle (e.g., 3 years) over a single ball bearing that may have a lower service (e.g., 4 months).

Top cap 605 can have an elongated cylindrical top cap body that extends along a central vertical axis where the top cap includes a top face, a bottom face, and an exterior perimeter surface defining an outer perimeter of the top cap body. Disclosed top caps 605 can include a polished rod opening 606 extending along the central vertical axis of the top cap body and is configured to receive a polished rod. Described top caps 605 include a nesting region 608 along the top face, the nesting region 608 configured to receive at least a portion of a polished rod clamp.

As shown in FIG. 6A, disclosed gear rod rotator systems include a central housing 640 having a generally hollow first annular tube along a central vertical axis and a generally hollow second annular tube along a longitudinal axis. Disclosed gear rod rotator systems include one-direction intermittent motion that can be achieved by, but not limited to, a ratchet mechanism, sheave mechanism, cam mechanism, and incomplete gear mesh. Gear rod rotator systems also include the ratchet mechanism received within the second annular tube, the ratchet mechanism including an actuator lever 645, a one-way clutch bearing for the actuator lever 650, a worm drive shaft 675, a one-way clutch bearing for the actuator lever 650, one-way clutch bearing key 651, and a worm drive shaft key 676. Described gear rod rotator systems include top cap rotating mechanisms that are received within the first annular tube and configured to drive rotation of top caps. The top cap rotating mechanisms include rod load bearings, worm gears comprising shear pins, sleeve centralizers, and top caps 605.

FIG. 6B illustrates another embodiment having a different top cap configuration where top cap 602 has a v-shaped inset region 603 and top cap sensor module 505. As shown in FIG. 6B, top cap 602 includes a v-shaped inset region 603, sensor mounting port hole 601 configured to receive top cap sensor 505, circular mounting rim 609, and a polished rod opening not visible from the angle of top cap 602 shown. Disclosed sensor mounting port hole 601 can be any depth including from about 0.01 inches to about 2 inches, can have any cross-sectional profile including circular and any polyhedron, and can include locking mechanisms configured to match with top cap sensor modules 505. For example, top cap sensor module 505 can be secured to sensor mounting port hole 601 with a thread, adhesive, snap-in, magnetic attraction, a separate construction or harness, gravity, or bolt on connection. Top cap sensor modules 505 can be installed during the manufacture of top caps or introduced post-manufacture at any time. Top cap sensor modules 505 can also be removed and re-attached at any time without reducing the integrity of the top cap or the top cap sensor modules 505. Additionally, top cap sensor modules 505 can be attached or removed without interrupting gear rod rotator function. Top caps 602 as described herein include top cap sensor mounting port hole 601 on the exterior perimeter surface, the top cap sensor mounting port hole 601 configured to receive a top cap sensor module 505 comprising a power supply, a sensor, and a sensor module transmitter.

Existing gear rod rotators do not have a locking bolt 665 as shown in FIGS. 6A and 6B, but instead use retaining rings to lock a clutch bearing or ratchet in place. Since there is no component to lock the actuator lever 645 in place, there is always a gap between actuator lever 645 and the housing, leaving the worm shaft drive 675 as a cantilever exposed to the environment. Dust, dirt, and sand can get into the central housing 640 through the gap and cause wear that can lead to early failure to all the internal worm drive shaft 675 components. The locking bolt 665 in present invention includes a shoulder bolt, which can be any shape, size, material or replaced by any other types of bolts and/or combines with washers, to lock the actuator and actuator lever end cap 655 in position and press against the housing, leaving minimum to no gaps between the end caps 655 and the sagittal cylinder. With this design feature, run time of all internal components is significantly prolonged.

Figure 6C:
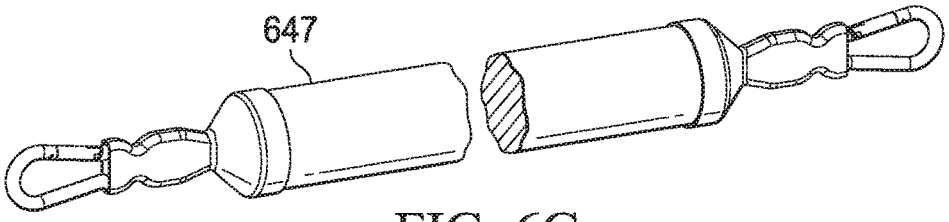
FIG. 6C illustrates an extension spring carabiner according to a specific example embodiments of the disclosure.

FIG. 6C illustrates an extension spring carabiner 647 used to connect one end of the actuator lever 645 to a cable generally clamped to the base of a horsehead or Samson post. Disclosed carabiner spring 647 can be made from any material such as metal or a polymer, can be any length from 1 inch to 36 inches, and can be configured to reduce or select a constant pull from the horsehead or Samson post on the actuator lever 645. By using carabiner spring 647 to specify a constant pull from the horse head or any other anchor point, actuator lever 645 can be used without putting undue stress on the gear rod rotator system since a threshold force can set to be placed on it. Therefore, a carabiner spring 647 may work in synergy with other disclosed gear rod rotator system components to reduce overall system wear and prevent or reduce downtime. For example, gear rod rotators can be configured for 400 pulls per rod rotation by adding a spring-carabiner assembly to the end of the actuator lever.

Figure 7A:
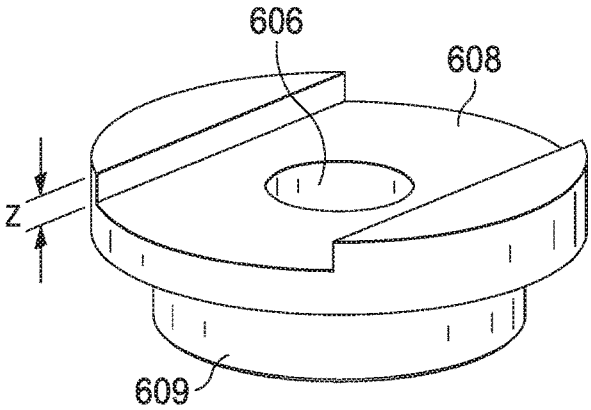
FIG. 7A illustrates an isometric view of a top cap with a nesting region having a rectangular cross-section according to a specific example embodiment of the disclosure.
Figure 7B:
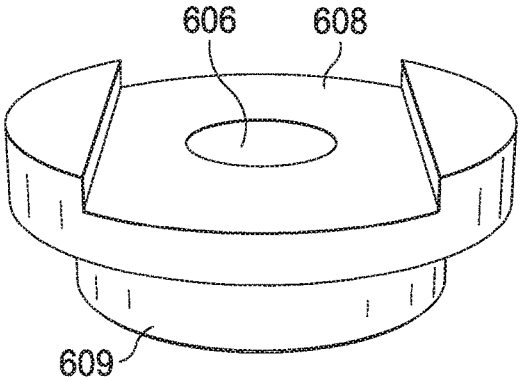
FIG. 7B illustrates an isometric view of the top cap of FIG. 7A with the nesting region having a rectangular cross-section according to a specific example embodiment of the disclosure.
Figure 7C:
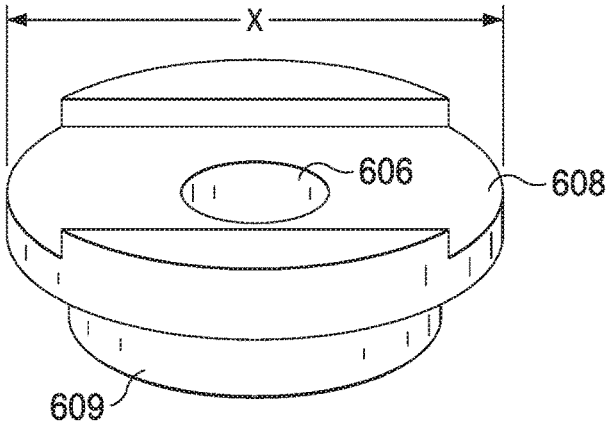
FIG. 7C illustrates an isometric view of the top cap of FIG. 7A with the nesting region having a rectangular cross-section according to a specific example embodiment of the disclosure.
Figure 7D:
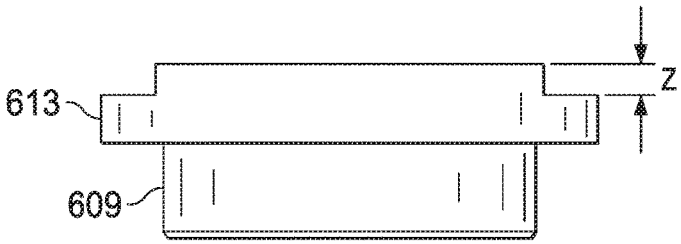
FIG. 7D illustrates a side view of the top cap of FIG. 7A with the nesting region having a rectangular cross-section according to a specific example embodiment of the disclosure.
Figure 7E:
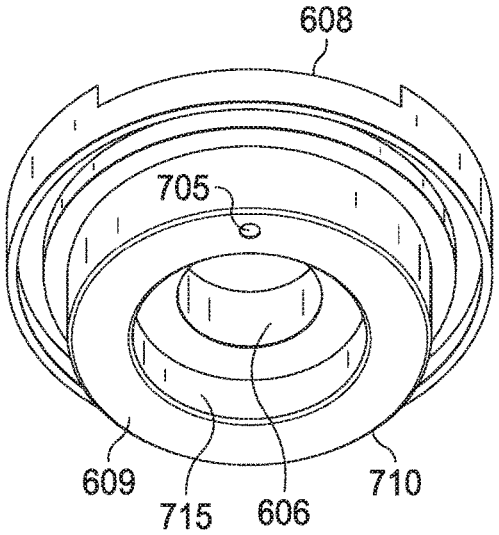
FIG. 7E illustrates an isometric view of the top cap of FIG. 7A with the nesting region having a rectangular cross-section according to a specific example embodiment of the disclosure.
Figure 7F:
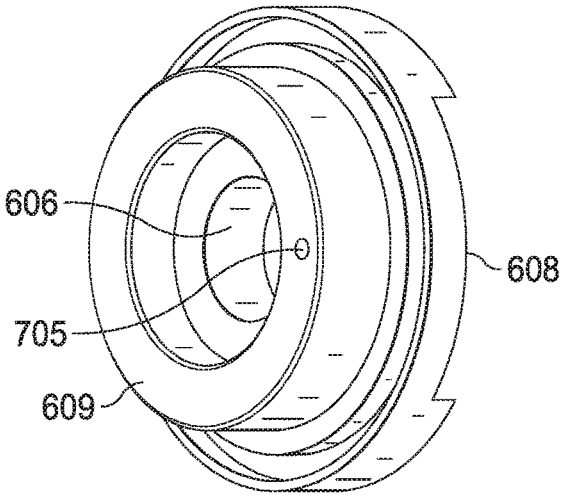
FIG. 7F illustrates an isometric view of the top cap of FIG. 7A with the nesting region having a rectangular cross-section according to a specific example embodiment of the disclosure.
Figure 7G:
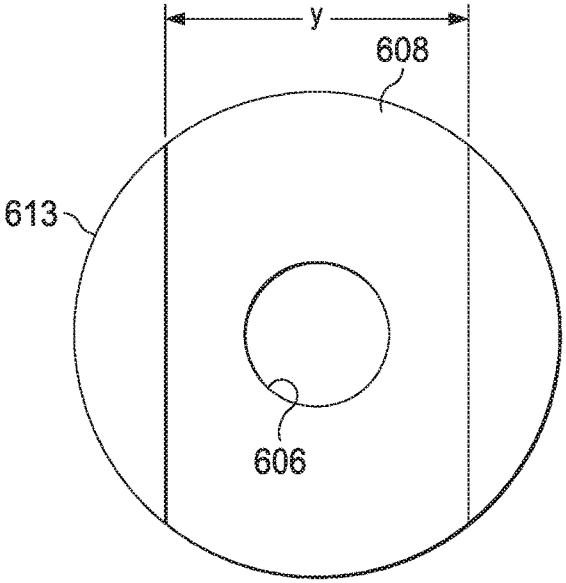
FIG. 7G illustrates a top view of the top cap of FIG. 7A with the nesting region having a rectangular cross-section according to a specific example embodiment of the disclosure.
Figure 7H:
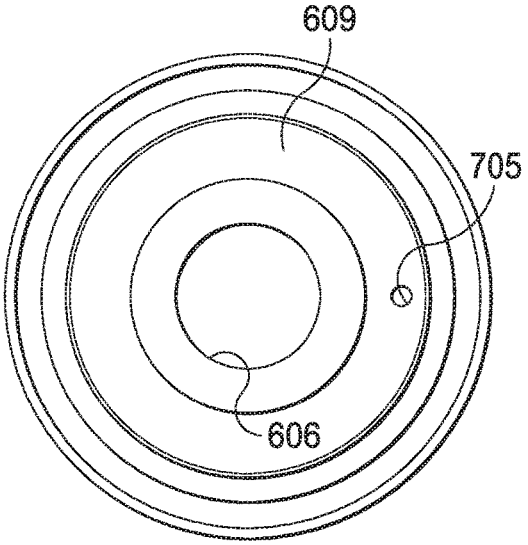
FIG. 7H illustrates a bottom view of the top cap of FIG. 7A with the nesting region having a rectangular cross-section according to a specific example embodiment of the disclosure.

FIGS. 7A-7G illustrate various isometric, side, top, and bottom views of a top cap having a nesting region. The nesting region can have various shapes, dimensions, and sizes including having a quadrilateral cross-section, a rectangular cross-section, a square cross-section, a curvilinear cross-section, a semi-circular cross-section, and combinations thereof. For example, as shown in FIGS. 7A-7G, the nesting region 608 may have a substantially rectangular cross-section. As shown in FIGS. 7C and 7E, the nesting region can have a width y and a length x. Width y includes a range from about 0.5 inches to 12 inches. Length x includes a range from about 0.5 inches to about 10 inches. As shown in FIGS. 7A and 7D, the nesting region can have a height z, the height z ranging from about 0.01 inches to about 12 inches. As disclosed in FIG. 7C, polished rod opening 606 has a diameter, the diameter ranging from about 0.5 inches to about 3 inches. FIG. 7E shows circular mounting rim 609 having an outer diameter 710, an inner diameter 715, and recess 705. Recess 705 is configured to receive a shear pin. The outer diameter 710 can range from about 1 inch to about 12 inches. The inner diameter 755 can range from about 0.5 inch to about 11.5 inches. Recess 705 has a diameter, the diameter ranging from about 0.01 inches to about 0.5 inches. Recess 705 has a depth from about 0.01 inches to about 6 inches.

Figure 8A:
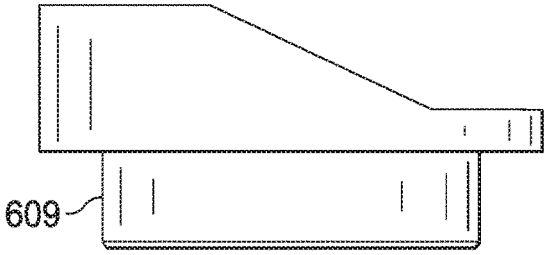
FIG. 8A illustrates a side view of a top cap having a v-shaped inset region according to a specific example embodiment of the disclosure.
Figure 8B:
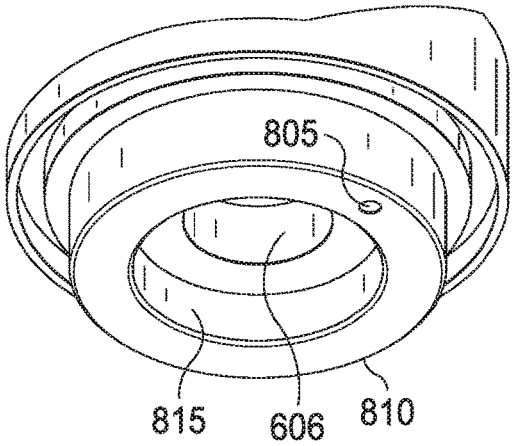
FIG. 8B illustrates an isometric view of the top cap of FIG. 8A having the v-shaped inset region according to a specific example embodiment of the disclosure.
Figure 8C:
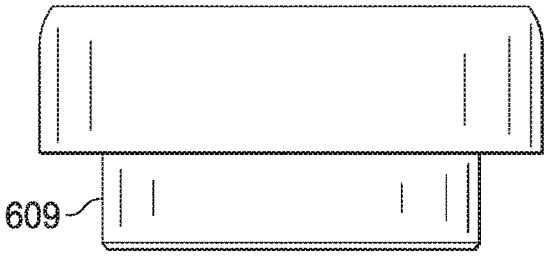
FIG. 8C illustrates a side view of the top cap of FIG. 8A having the v-shaped inset region according to a specific example embodiment of the disclosure.
Figure 8D:
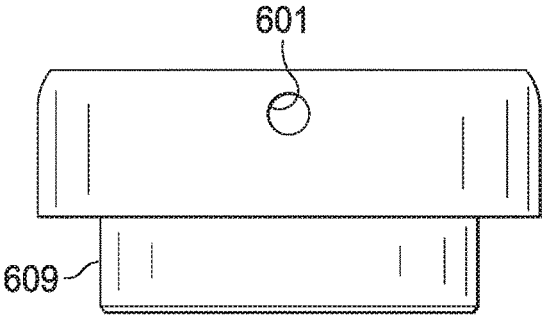
FIG. 8D illustrates a side view of the top cap of FIG. 8A having the v-shaped inset region with a sensor mounting port hole according to a specific example embodiment of the disclosure.
Figure 8E:
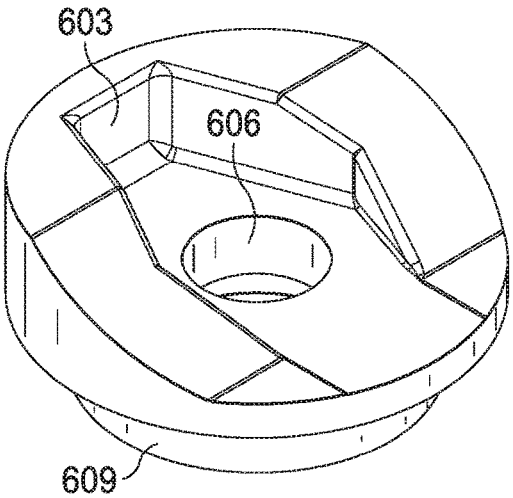
FIG. 8E illustrates an isometric view of the top cap of FIG. 8A having the v-shaped inset region according to a specific example embodiment of the disclosure.
Figure 8F:
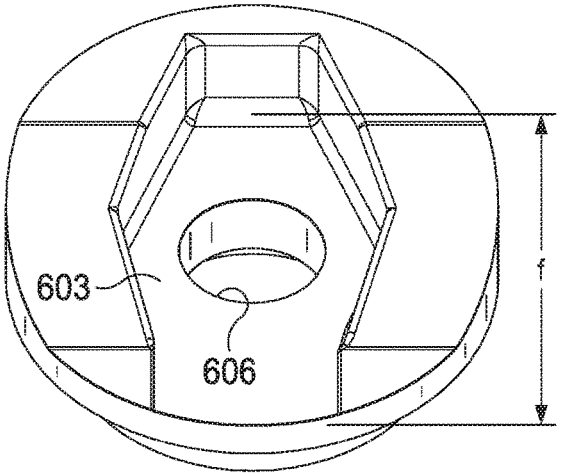
FIG. 8F illustrates an isometric view of the top cap of FIG. 8A having the v-shaped inset region according to a specific example embodiment of the disclosure.
Figure 8G:
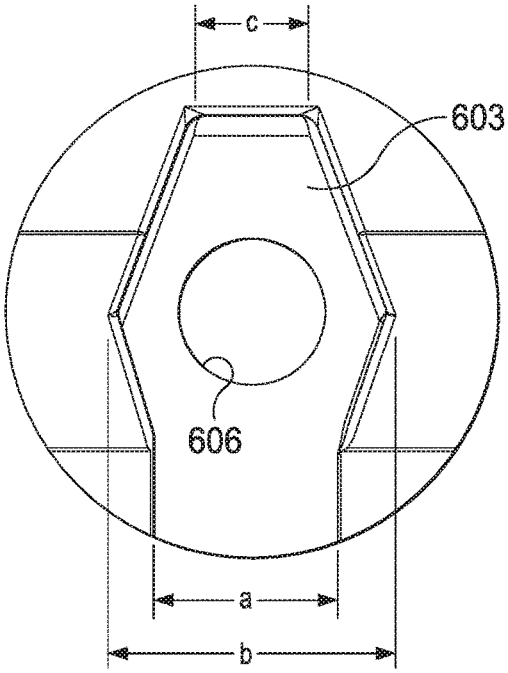
FIG. 8G illustrates a top view of the top cap of FIG. 8A having the v-shaped inset region according to a specific example embodiment of the disclosure.
Figure 8H:
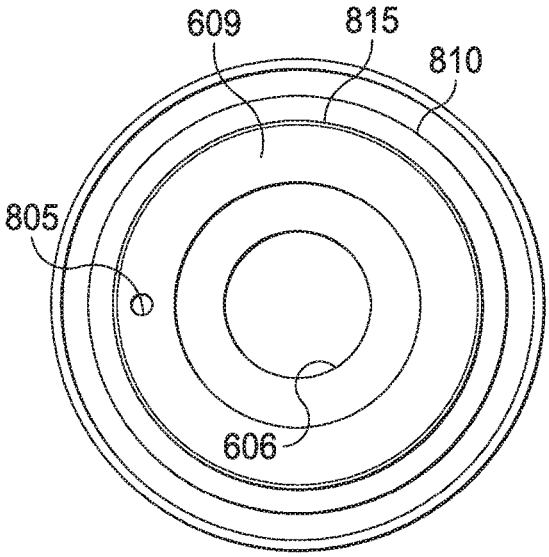
FIG. 8H illustrates a bottom view of the top cap of FIG. 8A having the v-shaped inset region according to a specific example embodiment of the disclosure.
Figure 8I:
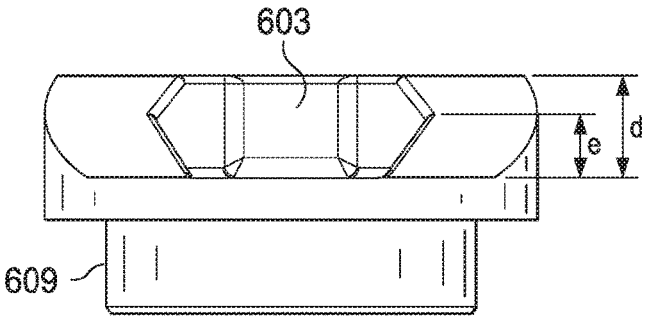
FIG. 8I illustrates a side view of the top cap of FIG. 8A having the v-shaped inset region according to a specific example embodiment of the disclosure.

FIGS. 8A-8H illustrate various isometric, side, top, and bottom views of a top cap having a nesting region with a v-shaped inset region. The nesting region can have various shapes, dimensions, and sizes including having a substantially "v" or "u" shape. For example, as shown in FIGS. 8A-8H, the nesting region 603 can be substantially v-shaped. As shown in FIG. 8G, the nesting region can have a more than one width a, b, c. Widths a, b, c include a range from about 0.5 inches to about 10 inches. Disclosed top caps nesting regions 603 can have various heights d, e; the heights d, e ranging from about 0.01 inches to about 12 inches, as shown in FIG. 8C. FIG. 8F depicts nesting region 603 with a length f, the length f ranging from about 0.1 inches to about 24 inches. FIG. 8D depicts sensor mounting port hole 601 having a diameter, length, or width depending on shape. Sensor mounting port hole 601 is configured to receive a top cap sensor module. The diameter, length or width ranges from about 0.01 inches to about 0.5 inches. Sensor mounting port hole 601 can have a depth ranging from about 0.01 inches to about 6 inches. As disclosed in FIG. 8E, polished rod opening 606 has a diameter, the diameter ranging from about 0.1 inches to about 2 inches. FIG. 8B shows circular mounting rim 609 having an outer diameter 810, an inner diameter 815, and lower recess 805. Recess 805 is configured to receive a shear pin. The outer diameter 810 can range from 1 inch to about 12 inches. The inner diameter 815 can range from about 0.5 inch to about 11 inches. Recess 805 has a diameter, length, or width depending on shape, the diameter, length or width ranging from about 0.01 inches to about 0.5 inches.

Figure 9A:
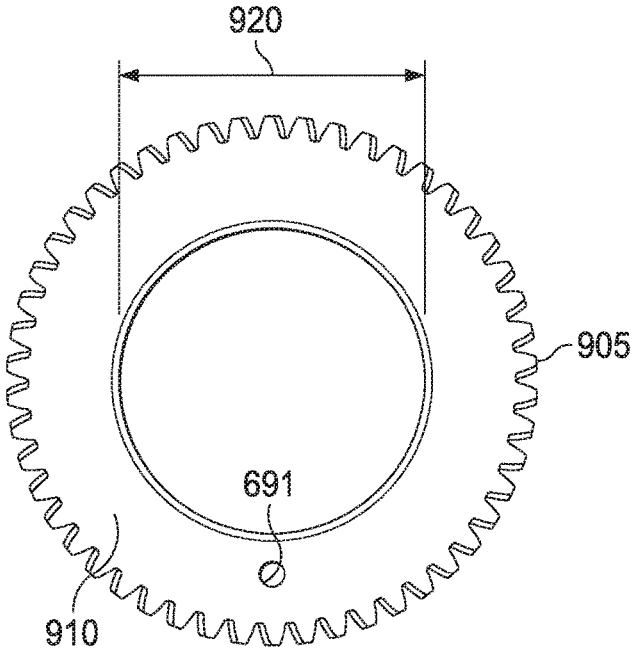
FIG. 9A illustrates a top view of a worm gear according to a specific example embodiment of the disclosure.
Figure 9B:
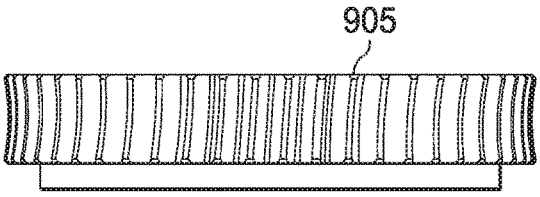
FIG. 9B illustrates a side view of the worm gear from FIG. 9A according to a specific example embodiment of the disclosure.
Figure 9C:
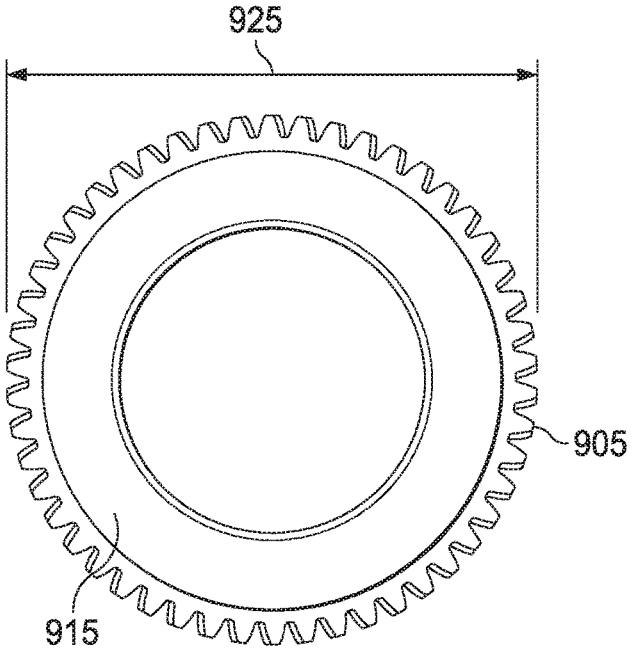
FIG. 9C illustrates a bottom view of the worm gear from FIG. 9A according to a specific example embodiment of the disclosure.
Figure 9D:
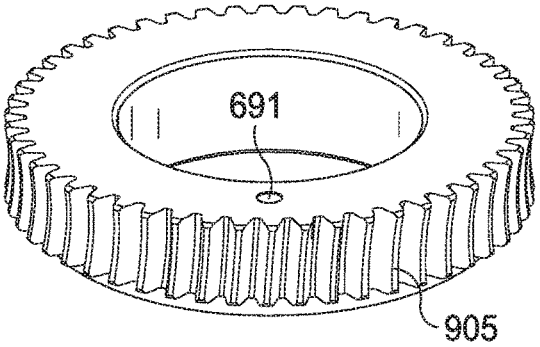
FIG. 9D illustrates an isometric view of the worm gear from FIG. 9A according to a specific example embodiment of the disclosure.

FIGS. 9A-9D illustrate a top, a side, a bottom, and an isometric view of a worm gear (e.g., worm wheel) according to a specific example embodiment of the disclosure. As shown in FIG. 9A, the worm gear includes any number of teeth 905, which may desirably provide for a gear ratio when coupled with a worm or worm drive. The worm gear teeth 905 can have any shape, which may correspond and/or compliment the shape of the worm or worm drive it is coupled with. As shown in FIG. 9A, described worm gears have a top portion 910, an inner diameter 920, an outer diameter 925, and a cylindrical recess 691. The outer diameter 910 can range from 1 inch to about 12 inches. The inner diameter 920 can range from about 0.5 inch to about 11 inches. The cylindrical recess 691, as shown in FIGS. 9A and 9D, has a diameter, the diameter ranging from about 0.01 inches to about 0.5 inches. The recess can have various shapes, sizes, and depths with respect to the top of the worm gear, which may be configured to receive shear pins of various shapes and sizes.

Figure 10A:
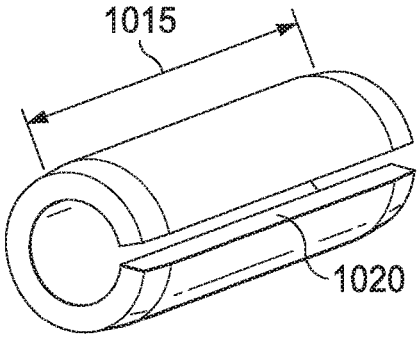
FIG. 10A illustrates an isometric view of a smooth and high breaking strength shear pin according to a specific example embodiment of the disclosure.
Figure 10D:
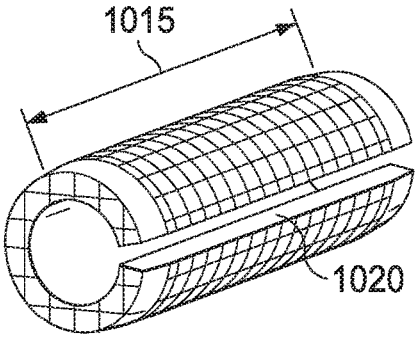
FIG. 10D illustrates an isometric view of a textured and low breaking strength shear pin according to a specific example embodiment of the disclosure.
Figure 10B:
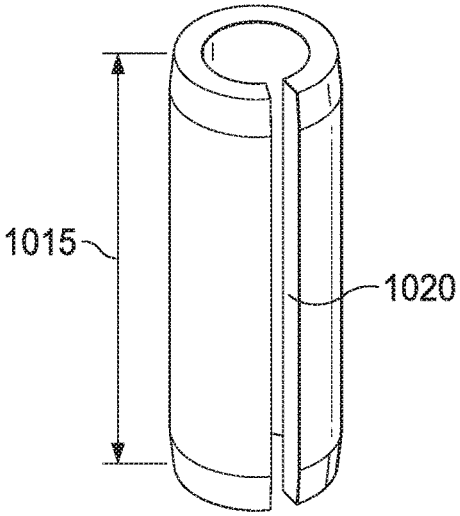
FIG. 10B illustrates an isometric view of the smooth and high breaking strength shear pin of FIG. 10A according to a specific example embodiment of the disclosure.
Figure 10E:
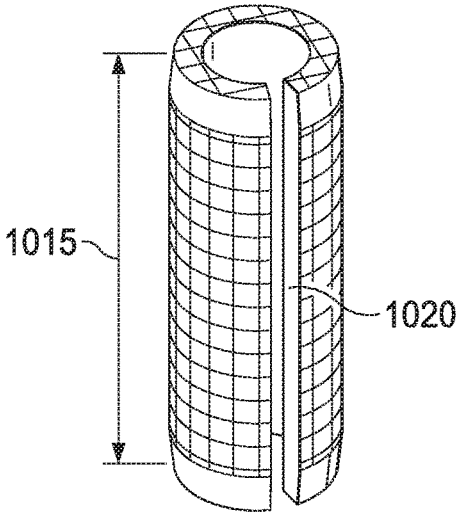
FIG. 10E illustrates an isometric view of the textured and low breaking strength shear pin of FIG. 10D according to a specific example embodiment of the disclosure.
Figure 10C:
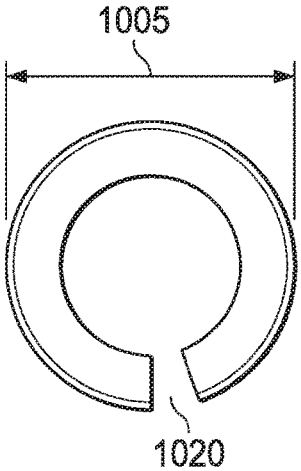
FIG. 10C illustrates a top view of the smooth and high breaking strength shear pin of FIG. 10A according to a specific example embodiment of the disclosure.
Figure 10F:
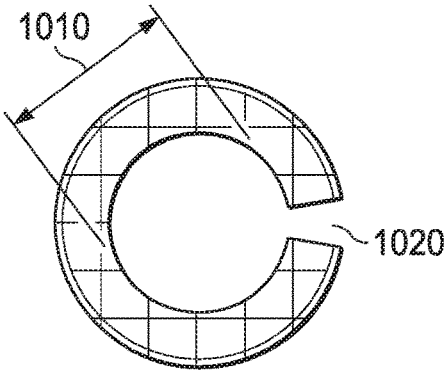
FIG. 10F illustrates a top view of the textured and low breaking strength shear pin of FIG. 10D according to a specific example embodiment of the disclosure.

FIGS. 10A-10F illustrate various isometric views of disclosed shear pins. A gear rod system includes a worm gear having a shear pin. Disclosed shear pins can be any shape, can have any breaking strength rating, and can be made of any material such as metal and plastic. The shear pins can be hollow, solid, cylindrical, rectangular, and prism shaped. In some embodiments, a linkage provides a lock-in and torque drive mechanism that may be achieved by ball spring plungers or a ball sitting in the groove. FIGS. 10A-10C are smooth shear pins according to a specific example embodiment of the disclosure. FIGS. 10D-10F are textured shear pins. As shown in FIG. 10B, described shear pins include a gap 1020 and a length 1015, the length ranging from about 0.25 inches to about 6 inches. The gap 1020 has a width from about 0.001 inches to about 0.1 inches and a length along the full length of the shear pin. As shown in FIG. 10C, described shear pins have an outside diameter 1005, the outside diameter ranging from about 0.05 inches to about 6 inches. For example, the outside diameter can be about 0.25 inches. As shown in FIG. 10F, disclosed shear pins have an inside diameter 1010, the inside diameter have a range from about 0.025 inches to about 5.5 inches. The shear pin or safety pin may be configured to transmit torque from a worm gear to a top cap. In some embodiments, the shear pin may transmit a torque from the worm gear to the top cap when a deviation of an oil well is configured to create a torsional torque above the torque transmitted through friction. A breaking strength of the shear pin may be selected to protect connections between the worm gear and the top cap that may be torqued in a manner causing catastrophic rod string failure. The shear pin may break at a torque from a predetermined torque up to about 1250 ft./lbs. For highly deviated wells, upper torque limit is designed to protect the integrity of the sucker rod and avoid torsional failures.

For example, the shear pin may break at a torque from about 600 ft./lbs. to about 1250 ft./lbs. For highly deviated wells, upper torque limit is designed to protect the integrity of the sucker rod and avoid torsional failures. For example, the shear pin may be configured to break at a torque of about 1218 ft./lbs, which may be below a torque that may cause wear, damage, or failure to shear pin connections, a string of reciprocating sucker rods, a worm gear, a worm drive, or any component of the gear rod system. Additionally, shear pins can be designed to break at a torque of about 695 ft./lbs. to provide further protection to system components. If the shear pin fail or shear, a rod rotator of the gear rod system may still function through an actuator lever. In some embodiments, if the shear pin fails, it may not continue to rotate a polished rod clamp and a string reciprocating of sucker rods, which would take the gear rod system out of service. In some embodiments, the shear pin that is configured to fit into the bottom of the top cap, thereby connecting to the worm gear set, may act as a safety device to prevent a rod string failure due to an over-torque from the rod rotator.

In a corresponding gear rod system having a nesting region including either an inset region or a locking fixture, and a shear pin, the shear force from the top plate may drive the string of reciprocating sucker rods to a torque for deviated wells. The rod string drive of a gear rod system having the nesting region and the shear pin may be limited by the shear pin limitations, since failure of the shear pin may disengage system components from each other. Therefore, the maximum torque of the gear rod system may be derived from the shear pin torque rating.

Figure 11A:
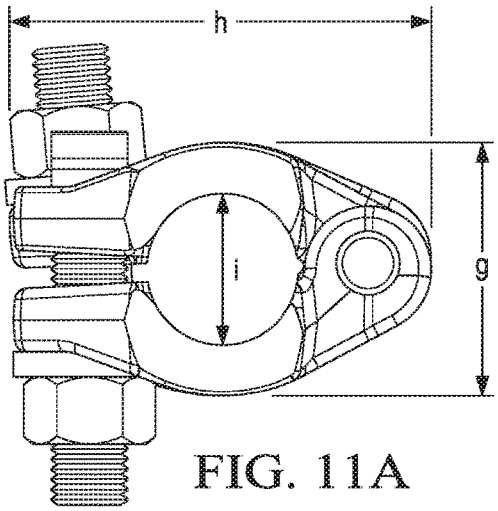
FIG. 11A illustrates a bottom view of a polished rod clamp, referred to as a 13,000-lb rated clamp section, according to a specific example embodiment of the disclosure.
Figure 11B:
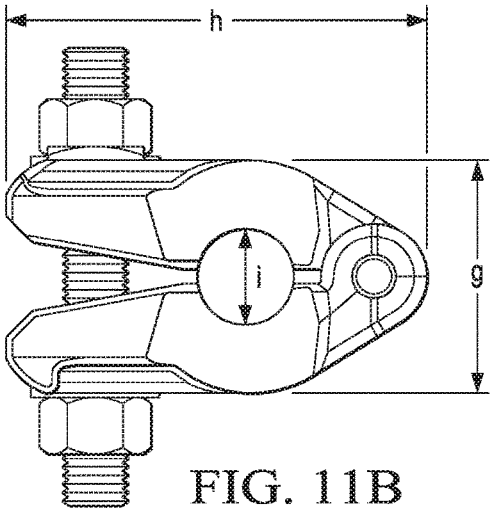
FIG. 11B illustrates a bottom view of a polished rod clamp, referred to as a 40,000-lb rated clamp section, according to a specific example embodiment of the disclosure.
Figure 11C:
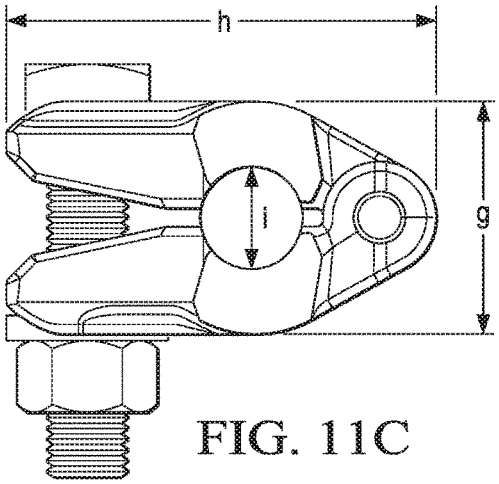
FIG. 11C illustrates a bottom view of a polished rod clamp, referred to as a 25,000-lb rated clamp section, according to a specific example embodiment of the disclosure.
Figure 11D:
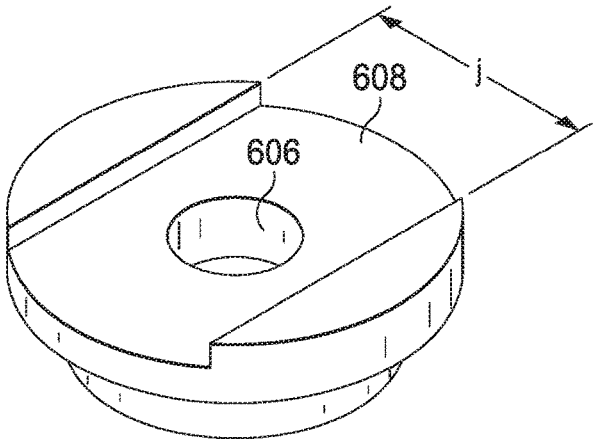
FIG. 11D illustrates an isometric view of a top cap with a nesting region having a rectangular cross-section before engaging a polished rod clamp according to a specific example embodiment of the disclosure.
Figure 11E:
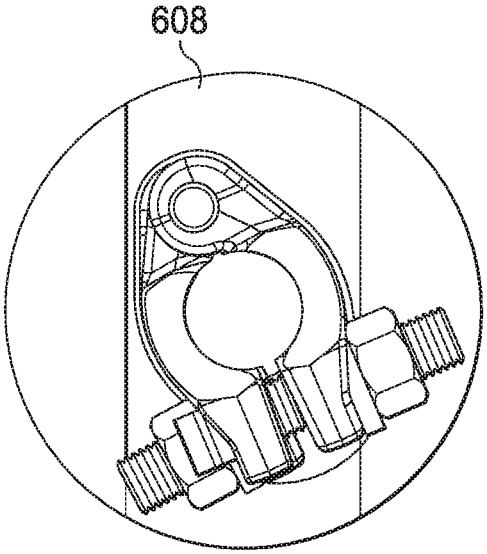
FIG. 11E illustrates a top view of a polished rod clamp engaging a top cap with a nesting region having a rectangular cross-section according to a specific example embodiment of the disclosure.
Figure 11F:
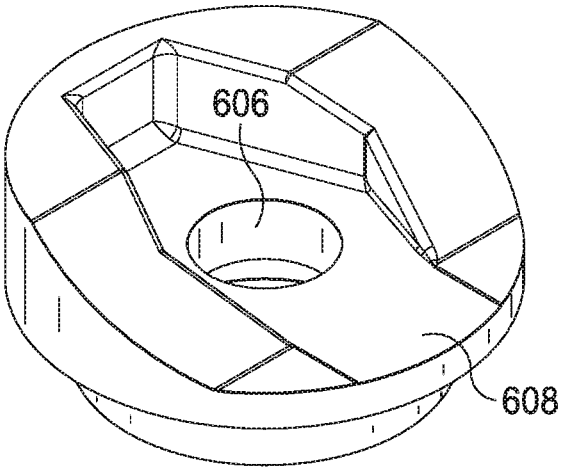
FIG. 11F illustrates an isometric view of a top cap with a v-shaped inset region not engaged with a polished rod clamp according to a specific example embodiment of the disclosure.
Figure 11G:
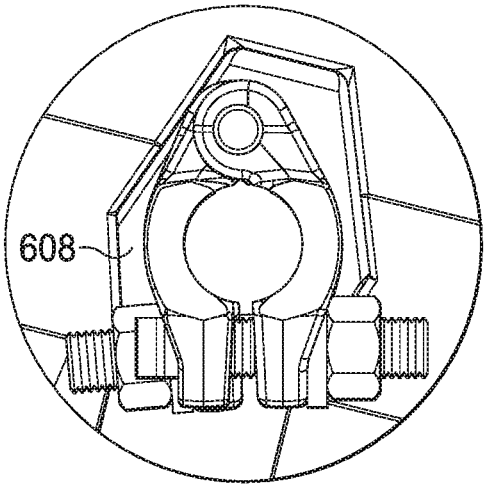
FIG. 11G illustrates a top view of a top cap with a v-shaped inset region engaged with a polished rod clamp according to a specific example embodiment of the disclosure.

A gear rod system may be configured to lock in or engage a polished rod clamp. For example, the top cap having a nesting region that may provide for the engagement by the polished rod clamp. FIGS. 11A-11G illustrate isometric views of the polished rod clamp and how it engages or conforms to the nesting region of the top cap. For example, as shown in FIG. 11A-11C, the top cap has a length g from about 2 inches to about 4 inches, including about 2.5 inches, about 2.8 inches, and about 3.6 inches. Top caps can have an inside diameter configured to secure polished rods having a diameter from about 0.5 inches to about 3 inches, including about 1.25 inches and about 1.5 inches. Top caps have a width h from about 3 inches to about 12 inches, including about 4.2 inches, about 5.3 inches, and about 6.6 inches. As shown in FIG. 11D, the inner walls j of the nesting region of the top cap may receive at least one polished rod clamp. FIGS. 11E and 11G illustrate how a top cap may be coupled or engaged by multiple polished rod clamps. As shown in FIGS. 11E and 11G, a polished rod clamp may securely engage the inner walls of the top cap with the nesting region having a rectangular cross-section or a v-shaped inset region. FIG. 11F illustrates the top cap with v-shaped inset region 606 not engaged with a polished rod clamp so the polished rod opening 606 is visible. However, the examples shown in FIGS. 11A-11G are just examples. The dimensions may conform to any shape or size of the polished rod clamp. For example, the nesting region can have a width from about 3 inches to about 6 inches, or from about 2.5 inches to about 4 inches, or from about 2 inches to about 5 inches. The depth of the nesting region can have from about 0.1 inches to about 3.0 inches. For example, the inset region can have a depth of about 0.74 inches or about 1.25 inches. In some embodiments, the walls of the nesting region may drive a rotation of the polished rod clamp and thus the string of reciprocating sucker rods.

Figure 12A:
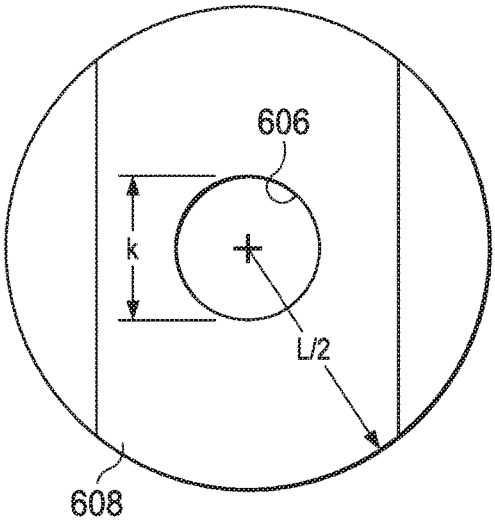
FIG. 12A illustrates a top view of a top cap showing the diameter of the hole that receives the sucker rod string and the width of the nesting region having a rectangular cross-section according to a specific example embodiment of the disclosure.
Figure 12D:
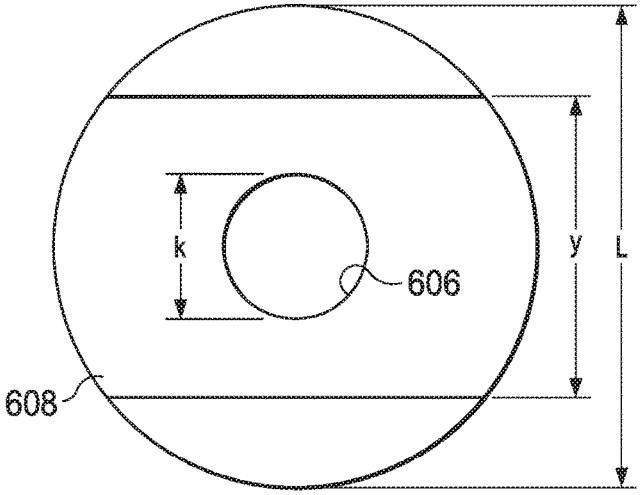
FIG. 12D illustrates a top view of a top cap showing the diameter of the hole that receives the sucker rod string and the width of the nesting region having a rectangular cross-section according to a specific example embodiment of the disclosure.
Figure 12B:
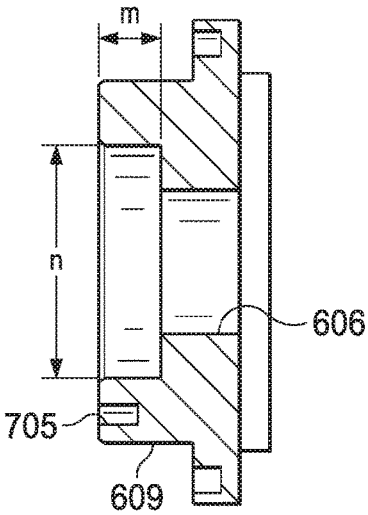
FIG. 12B illustrates a section view of a top cap with a nesting region having a rectangular cross-section showing various dimensions of the top cap according to a specific example embodiment of the disclosure.
Figure 12E:
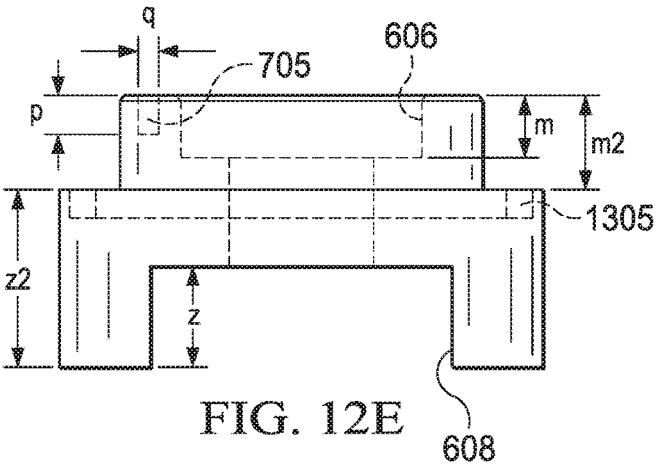
FIG. 12E illustrates a side view of a top cap showing various dimensions of the top cap with a nesting region having a rectangular cross-section according to a specific example embodiment of the disclosure.
Figure 12C:
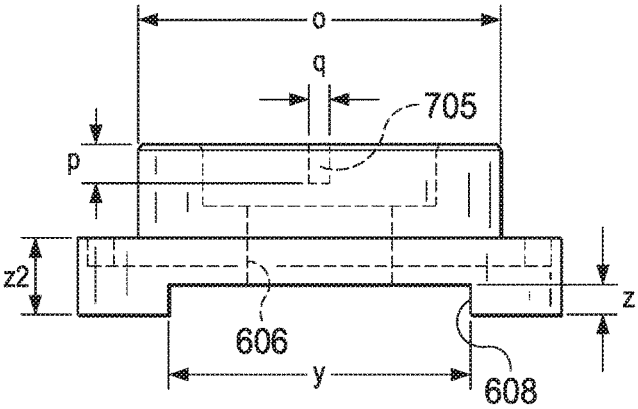
FIG. 12C illustrates a side view of a top cap showing various dimensions of the top cap with a nesting region having a rectangular cross-section according to a specific example embodiment of the disclosure.

FIGS. 12A-12E illustrate a top view and various perspectives of a top cap. As shown, the top cap can have various dimensions to conform to the dimensions of varying polished rod clamps and polished rods. The polished rod openings of the top caps can have diameters k ranging from about 1 inch to about 6 inches, including about 1.8 inches. Top caps can have diameters L ranging from about 1 inch to about 12.5 inches, including about 6 inches. Mounting rim 609 can have a depth m from about 0.1 inches to about 2 inches, including about 0.75 inches. Mounting rim 609 can have an inside diameter n from about 1 inch to about 6 inches, including about 2.9 inches; and an outside diameter o ranging from about 1 inch to about 10 inches, including about 4.5 inches. Recess 705 for receiving a shear pin can have a depth p from about 0.1 inches to about 1 inch, and a width q from about 0.1 inches to about 1 inch, as shown in FIGS. 12C and 12E. Disclosed top plates can have a nesting region height z from about 0.1 inches to about 10 inches, including about 1.25 inches. Described top caps can have a nesting region with a width y with a range from about 0.5 inches to about 12 inches, including about 3.75 inches. Mounting rim 609 of the top caps includes a second height m2 ranging form about 0.2 inches to about 10 inches, including 0.9 inches. The nesting region also includes a second height z2 ranging from 0.1 inches to about 11 inches, including about 2.2 inches.

Figure 13B:
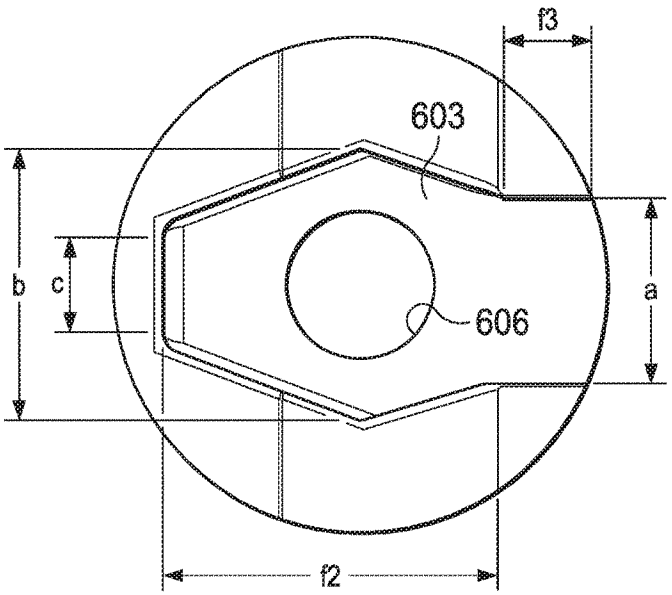
FIG. 13B illustrates a top view of a top cap with a v-shaped inset showing various component dimensions according to a specific example embodiment of the disclosure.
Figure 13D:
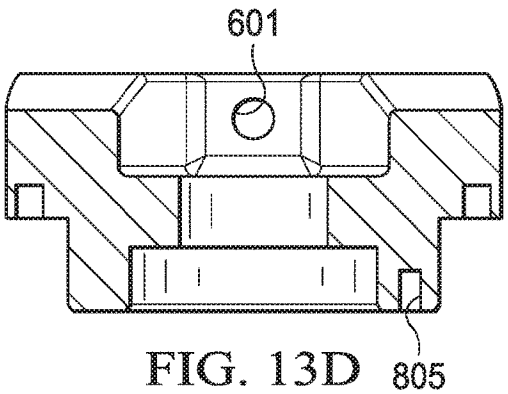
FIG. 13D illustrates a side view of a top cap with a v-shaped inset region showing shear pin hole and sensor mounting port hole according to a specific example embodiments of the disclosure.
Figure 13A:
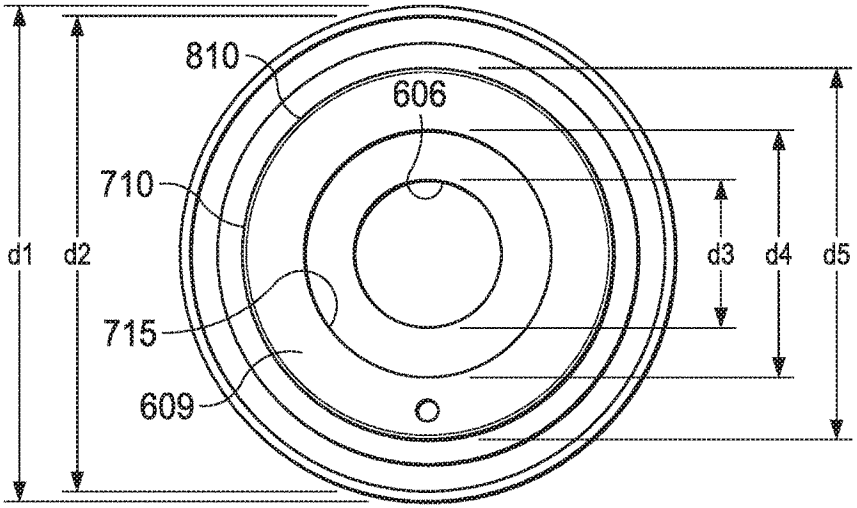
FIG. 13A illustrates a bottom view of a top cap with a v-shaped inset showing various component diameters according to a specific example embodiment of the disclosure.
Figure 13C:
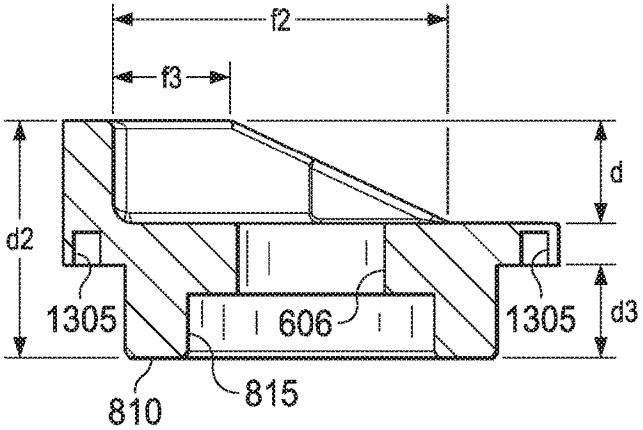
FIG. 13C illustrates a side view of a top cap with a v-shaped inset showing various component dimensions according to a specific example embodiments of the disclosure.
Figure 14A:
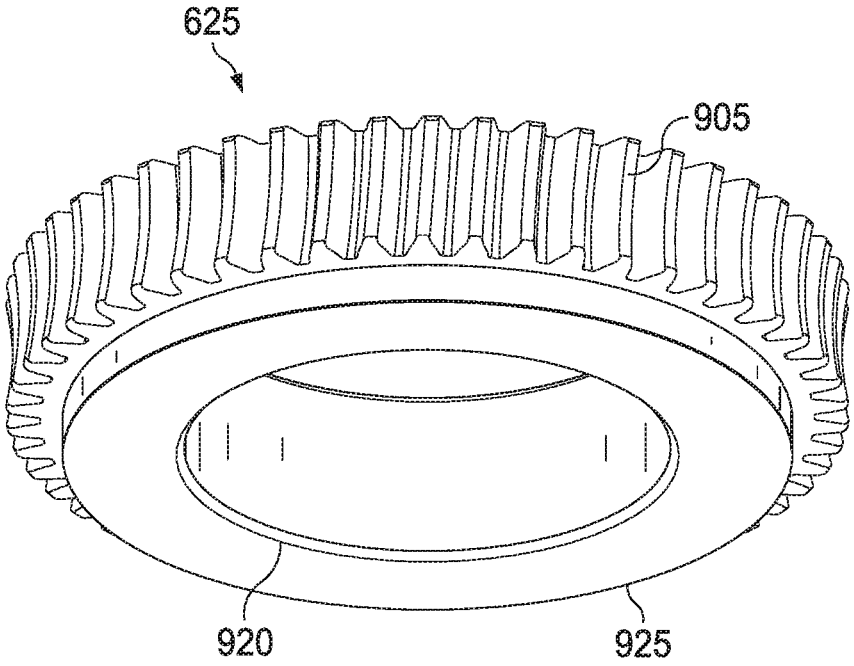
FIG. 14A illustrates an isometric view of a worm gear according to a specific example embodiment of the disclosure.
Figure 14B:
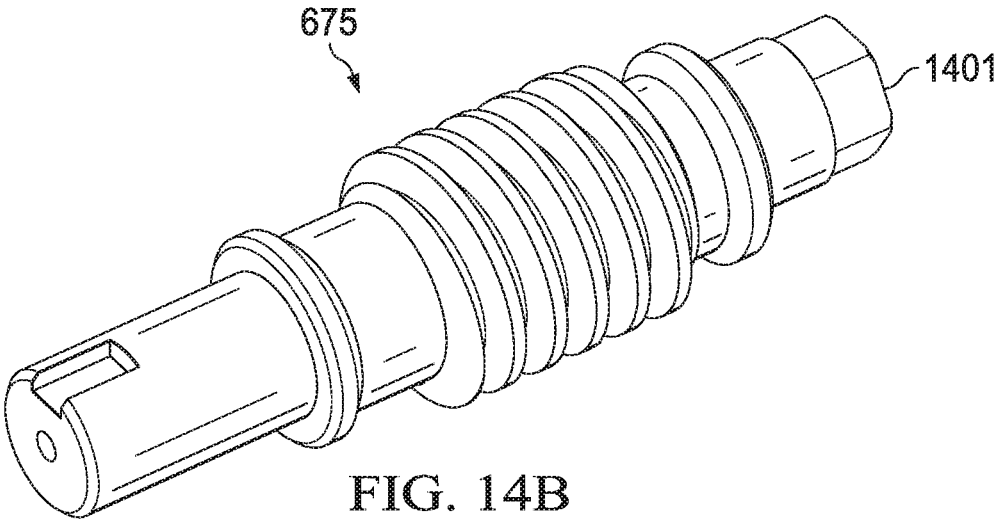
FIG. 14B illustrates an isometric view of a worm shaft according to a specific example embodiment of the disclosure.

FIGS. 13A-13D illustrate a bottom view FIG. 13A, a top view FIG. 13B, a side view FIG. 13C, and another side view FIG. 13D of a top cap having a v-shaped inset region. As seen in FIG. 13A, disclosed top caps have a top cap outer diameter d1 ranging from about 3 inches to about 10 inches, a top cap lip diameter d2 ranging from about 2.75 inches to about 9.75 inches, mounting rim outer diameter d5 ranging from about 2.5 inches to about 9.5 inches, mounting rim inner diameter d4 ranging from about 2.4 inches to about 9.4 inches, and polished rod opening diameter ranging from about 0.5 inches to about 6 inches. As shown in FIG. 13B, top cap have widths a, b, c that range from about 0.5 inches to about 10 inches. Described top caps have lengths f2, f3 ranging from about 0.01 inches to about 10 inches. Top caps as disclosed herein can also include an O-ring groove 1305 configured to receive O-ring 635. O-ring groove 1305 can be any depth from about 0.1 inches to about 1.0 inch. The total height d2 of the disclosed top caps can range from about 1 inch to about 16 inches. Additionally, the height of the inset d can range from about 0.01 inches to about 12 inches. The lengths f2, f3 of inset region can range from about 0.1 inches to about 24 inches. As shown in FIG. 13D, top caps include a sensor mounting port hole 601 and a recess 805. Recess 805 has a diameter, length, or width depending on shape, the diameter, length or width ranging from about 0.01 inches to about 0.5 inches. The sensor mounting port hole 601 can be any depth including from about 0.01 inches to about 2 inches FIGS. 14A-14B illustrate isometric views of disclosed worm gears 625 and worm drive shafts 675. The worm gear can have any number or shape of teeth. Additionally, the worm or worm shaft can have a pinion or worm thread of any shape or cut. The worm gear can have any gear ratio, which may be calculated as a ratio of gear teeth to the number of threads on the worm rod. For example, the worm gear can have a gear ratio of about 1 to about 50, or about 1:50. A gear ratio of about 1:50 may provide for a slower rotation speed in comparison to corresponding worm gear with a lower ratio such as about 1:40. Additionally, a gear ratio of about 1:50 may provide for a gear rod rotator system having a rotation speed of about 200 lever pulls per rod (sucker rod) revolution. A slower rotation speed may desirably contribute to uniform distribution of coupling and tubing wear, decreasing paraffin buildup, and a reduced part failure to due to well bore hole-in-tubing and couplings wear. The slower rotation speed may desirably reduce trapped torque downhole from the turning string of reciprocating sucker rods, which may provide for increased wear on a sucker rod pump and the tubing. The slower rotation will also increase the fatigue life of the bearings, avoiding frequent production interruption in the pumping unit.

As shown in FIG. 14B, worm drive shaft 675 includes a hex head end 1401 at an end. The hex head end 1401 of the worm drive shaft 675 is fully contained inside of the rod rotator sagittal hollow cylinder 642, which makes it difficult if not impossible to hold the worm shaft and tight the locking bolt from the other end. In some embodiments, disclosed hex head ends 1401 include a design for an easier assembly mechanism, including one or two flat surfaces, an Allen wrench slot, a Philips screw driver slot, and a flat head screw driver slot. The easier assembly mechanism may desirably provide for a point of contact that can be used to hold the hex head end 1401 socket wrench, adjustable wrench, basin wrench, or pipe wrench while tightening a locking bolt 665.

Figure 15A:
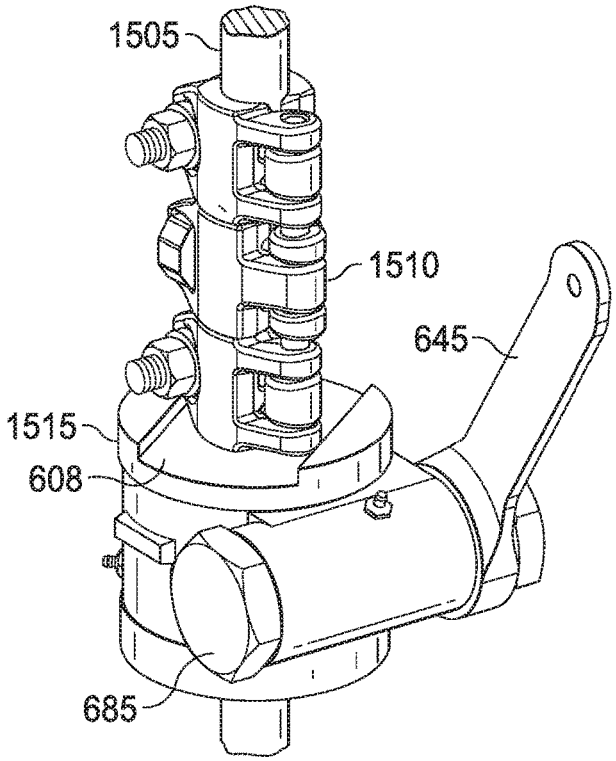
FIG. 15A illustrates an isometric view of a polished rod clamp engaging a top cap having a nesting region with a rectangular cross-section according to a specific example embodiment of the disclosure.
Figure 15B:
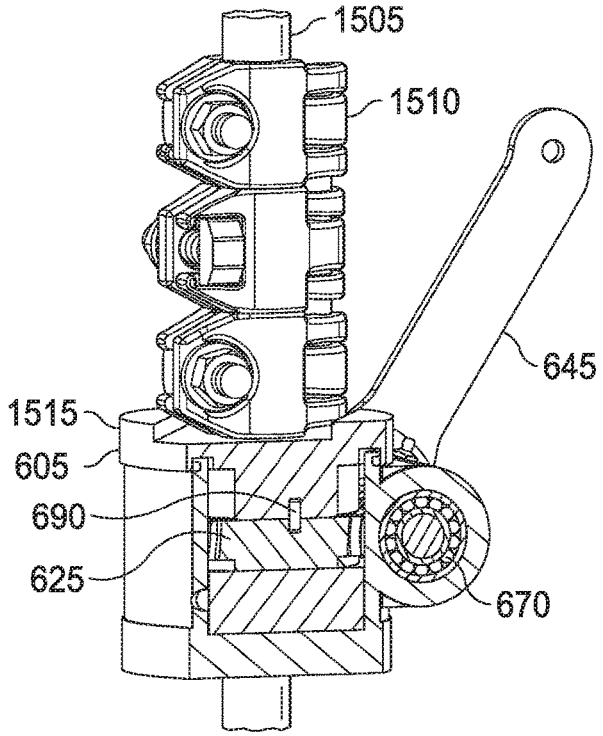
FIG. 15B illustrates an isometric and cross-sectional view of the polished rod clamp from FIG. 15A engaging the top cap with the nesting region with the rectangular cross-section and the shear pin according to a specific example embodiment of the disclosure.
Figure 15C:
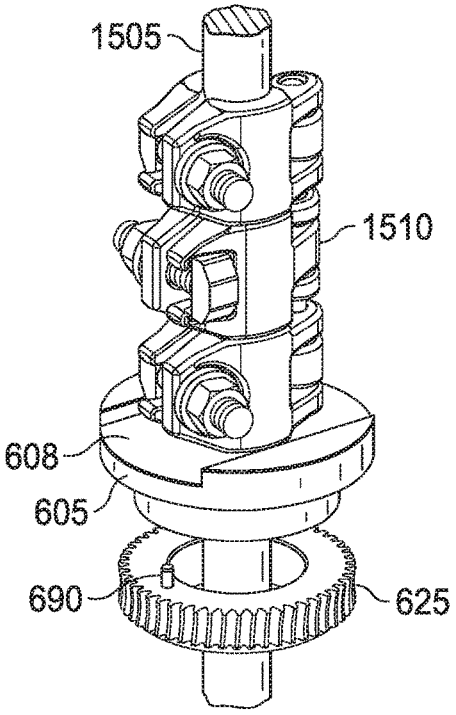
FIG. 15C illustrates an isometric view of the polished rod clamp from FIG. 15A engaging the top cap with top cap separated from the worm gear and shear pin.

FIGS. 15A-15C illustrate isometric views of a polished rod clamp engaging or locking in the Top cap of a gear rod rotator system and a polished rod. FIG. 15A discloses polished rod 1505 secured to a gear rod rotator system 1515 through polished rod clamps 1510. FIG. 15B shows an internal view of a polished rod clamp 1510 engaging a polished rod 1505 and a gear rod rotator system 1515 having a top cap 605, a shear pin 690, and a worm gear 625. FIG. 15C shows the positioning of a top cap right above shear pin 690 and worm gear 625.

Figure 16A:
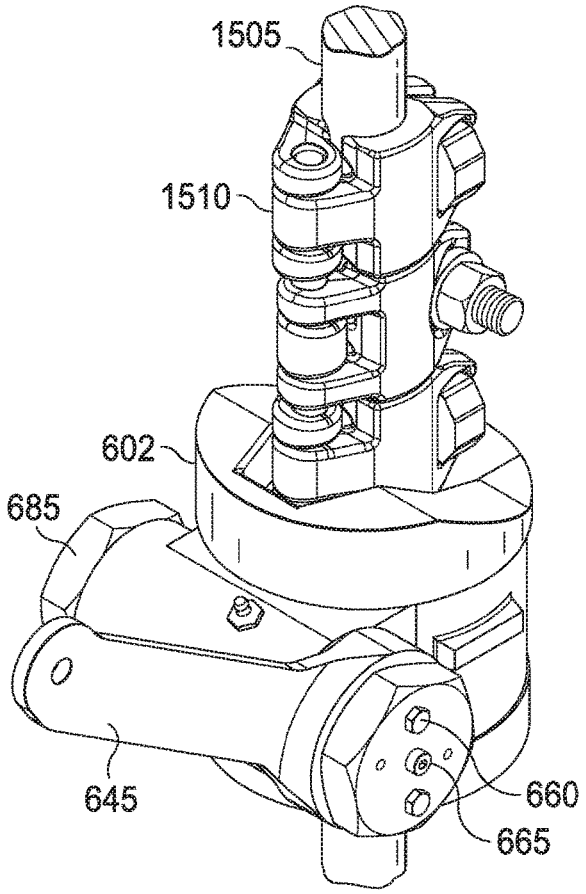
FIG. 16A illustrates an isometric view of a polished rod clamp engaging a rotator rod with a top cap having a v-shaped inset according to a specific example embodiment of the disclosure.
Figure 16B:
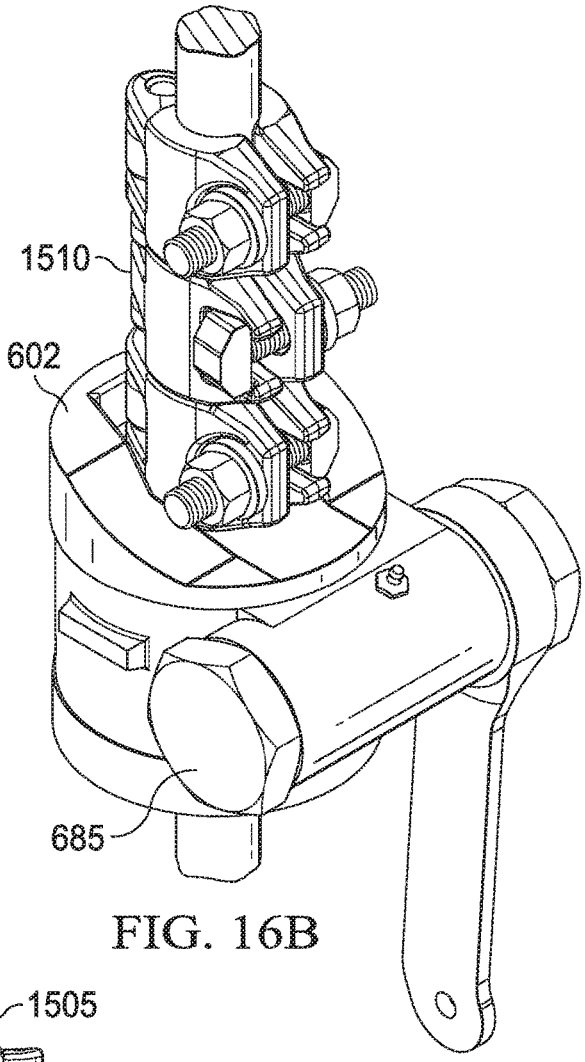
FIG. 16B illustrates an isometric view of the polished rod clamp engaging the top cap from FIG. 16A having a v-shaped inset according to a specific example embodiment of the disclosure.
Figure 16C:
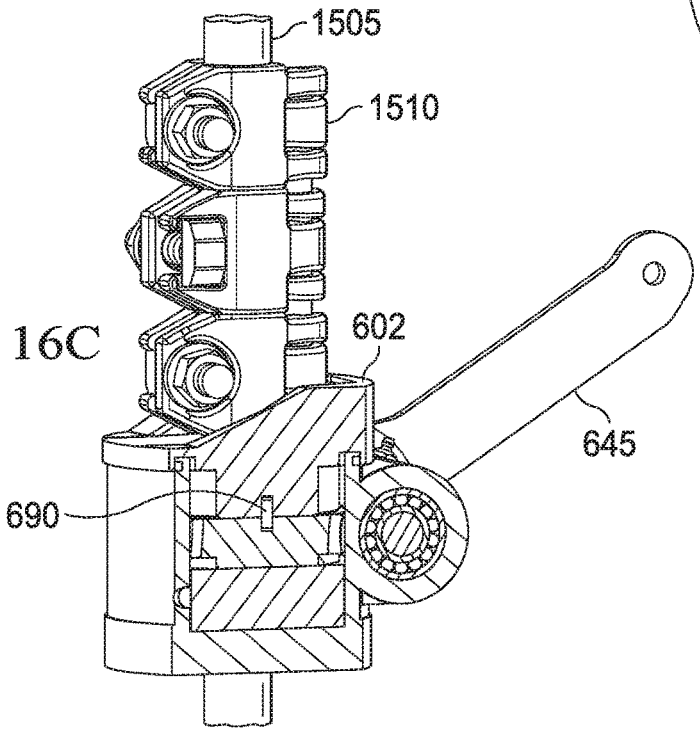
FIG. 16C illustrates an isometric and cross-sectional view of the polished rod clamp engaging the top cap from FIG. 16A having a v-shaped inset region and a shear pin according to a specific example embodiment of the disclosure.

FIGS. 16A-16B show isometric views and photographs of gear rod rotator systems having top caps with v-shaped inset regions. FIG. 16A depicts a gear rod rotator system having polished rod 1505 engaging top cap 602 through the polished rod clamp 1510 and the polished rod opening 606 of the top cap. FIG. 16B is an isometric view of the same showing polished rod clamp 1510 interacting with top cap 602. FIG. 16C illustrates an isometric review and cross-sectional view of a top cap 602 having a v-shaped inset region engaging polished rod clamp 1510 and polished rod 1505.

Figure 17A:
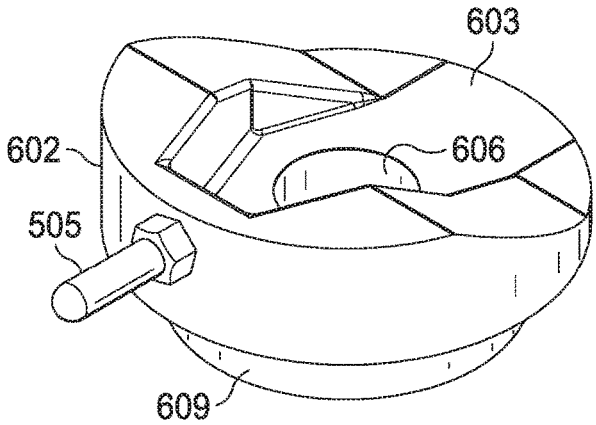
FIG. 17A illustrates an isometric view of a top cap having a top cap sensor module at a 90° angle according to a specific example embodiment of the disclosure.
Figure 17B:
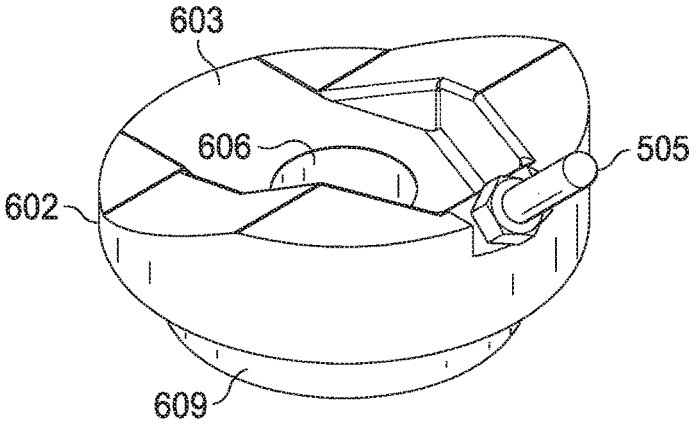
FIG. 17B illustrates an isometric view of the top cap from FIG. 17A having the top cap sensor module at a 45° angle according to a specific example embodiment of the disclosure.

FIGS. 17A and 17B illustrate top cap sensor modules 505 mounted to, connected to, or engaging the top plate 602 at various angles. Top cap sensor module 505 can engage top plate 602 at any angle from about 1° to about 179°. As shown in FIG. 17A, top cap sensor module 505 can be oriented at an about 90° angle with respect to side of the top plate 602. Additionally, as shown in FIG. 17B, top cap sensor module 505 can be oriented at an about 45° angle with respect to side of the top plate 602.

Figure 18:
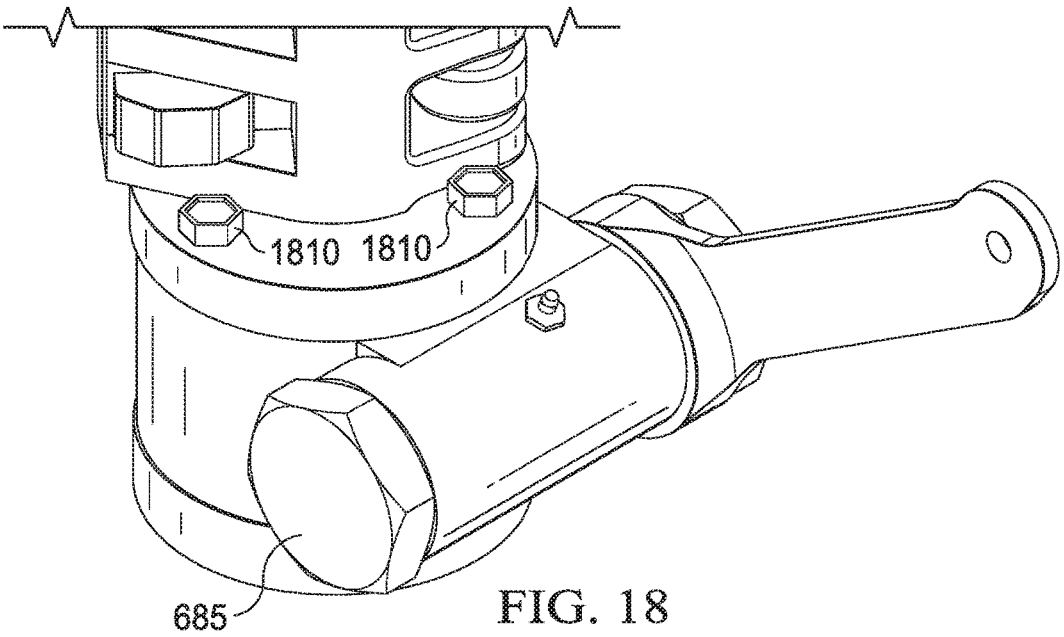
FIG. 18 illustrates an isometric view of a top cap with removable head bolts according to a specific example embodiment of the disclosure.

FIG. 18 illustrates an isometric view of a top cap with removable head bolts according to a specific example embodiment of the disclosure. In some embodiments, fasteners 1810 may have a hexagonal head. Fasteners 1810 may have any type of head including slot, Phillips, Pozidiriv, square, Robertson, hex, hex socket, security hex socket, torx, security torx, tri-wing, torq-set, spanner head, triple square, polydrive, one-way, spline drive, double hex, pentalobular, and Bristol. Fasteners 1810 can be stainless steel, zinc plated clear, zinc-plated yellow, galvanized, and black oxide. Fasteners 1810 may drive the rod string rotation by locking in the polished rod clamp.

Figure 19:
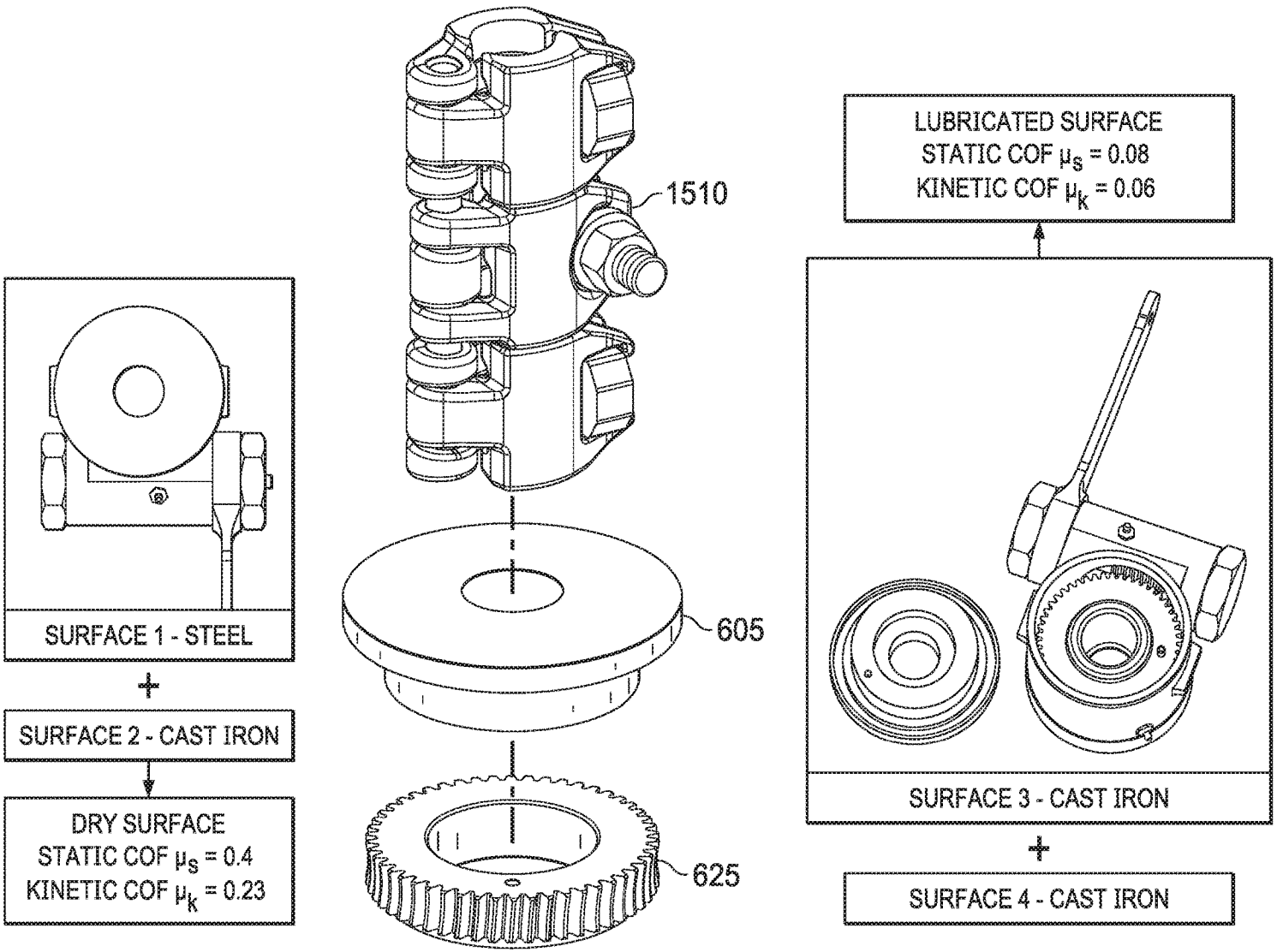
FIG. 19 illustrates an isometric view of a separated gear rod assembly.

FIG. 19 illustrates an isometric view of a gear rod assembly including worm gear 625, top cap 605, and polished rod clamps 1510. FIG. 19 also describes the static and kinetic coefficient of friction (COF) values for lubricated and dry surfaces. For a lubricated surface the static COF may be $\mu_s$=0.08 and the kinetic COF $\mu_s$ may be 0.06. For a dry surface the static COF may be $\mu_s$=0.4 and the kinetic COF $\mu_s$ may be 0.23.

Figure 20:
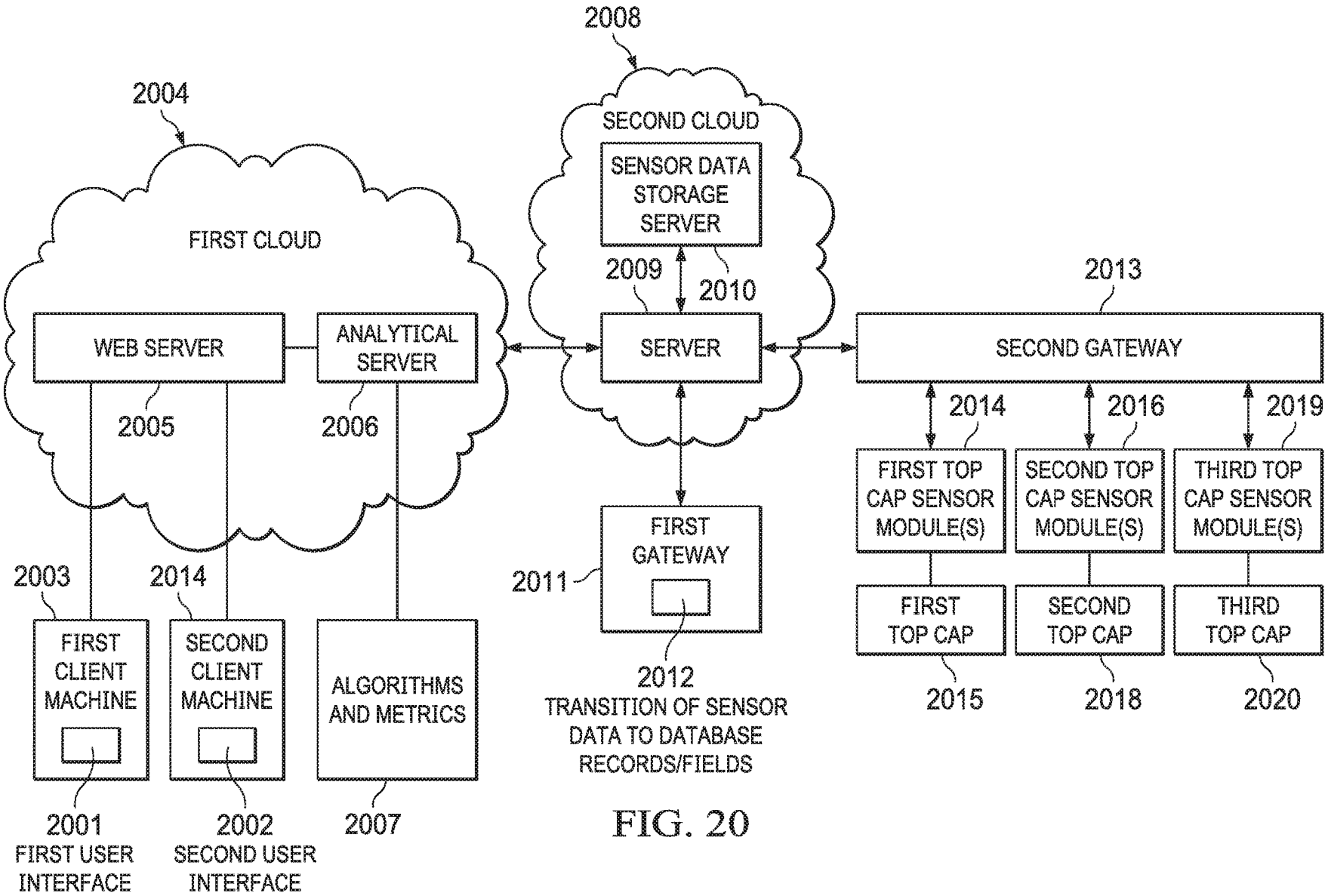
FIG. 20 illustrates a system diagram showing the connectivity of components linking users to top cap sensor modules, according to an embodiment of the disclosure.

FIG. 20 illustrates a system for gear rod rotator system monitoring. As shown in FIG. 20, disclosed systems for gear rod rotator system monitoring contain cloud based wireless communication servers 2004 including web servers 2005 and analytical servers 2006. Described cloud-based wireless communication servers 2004 facilitate communication between user interfaces 2001, 2002 and top cap sensor modules 2014, 2016, 2019, which provide remote-to-control location access to the information being gathered by the top cap sensor modules. Also, the cloud-based wireless communication servers 2004 transmit, aggregate, compute, and analyze data measured by the top cap sensor modules. Wireless communication servers 2004 include computing environments having, among other units, a processor, a memory unit, an input/output (I/O) unit, a communication unit, a resource allocator, and a location determinator Information gathered from the sensors by the user gives useful data regarding the health and normal operating parameters of the top caps.

Additionally, top cap sensor modules can be used in methods for determining the status of reciprocating rods. For example, the sensor can receive at least a portion of a feedback at a sensor from the reciprocating rod, construct a signal from the feedback received at the sensor, transmit the signal from the sensor to a computer processor, and generate display signals, operable to be received by a visual display.

Top Cap 2015 described in disclosed embodiments of this application include one-or-more top cap sensor modules 2014 as described above. The top cap sensor modules 2014 are operable to measure, aggregate, compute, and transmit temperature, vibration, and/or position data from the top cap sensor module 2014 to gateways 2013. Similarly, a gear rod rotator system may include one-or-more additional top caps 2018, 2020 that also include their own associated top cap sensor modules 2016, 2019. The described top cap sensor modules 2014, 2016, 2019 are operable to transmit data obtained from their respective top caps through a gateway 2013 to a cloud-based wireless communication server 2009, which further may include sensor data storage server 2010. Within the cloud-based wireless communication servers 2008 described in this application, data may transfer from server 2009 to the sensor data storage server 2010. Data may be communicated from the gateway 2013 to server 2009 and further to a cloud-based wireless communication server 2004. Described cloud-based wireless communication servers 2004, 2008 include computing environments having, among other units, a processor, a memory unit, an input/output (I/O) unit, a communication unit, a resource allocator, and a location determinator Information gathered from the top cap sensor modules by the user gives useful data regarding the health and normal operating parameters of the gear rod rotator.

A processor includes a programmable processing unit, a memory, a random-access memory, a network interface controller, a motherboard, an input device, and an output device, wherein the processor is configured to monitor and control the system for extracting the organic compound from the natural source. A processer also includes a cloud based controlling system, a programmable logic controller, a feedback control system, an on-off control system, a linear control system, a fuzzy logic control system, or a combination thereof.

Collectively, the disclosed systems for gear rod rotator monitoring as described in this application may include multiple top cap sensor modules 2014, 2016, 2019 and top caps 2015, 2018, 2020 permit a user and/or an automated analysis program to transmit, aggregate, compute, and analyze multidimensional sensor module measured data for a series of top caps 2015, 2018, 2020 simultaneously and separately. Although in the present figure, three such top caps/top cap sensor modules are shown, in applications consistent with this disclosure such systems may include four, five, six, or any other number of additional top caps and top cap sensor modules in accordance with design requirements. Further, although in the present application each top cap is shown with a single top cap sensor module, effective embodiments can provide for the sensing of multiple top caps by a single top cap sensor module, or for that matter multiple top cap sensor modules could communicate with single top cap according to design requirements.

Disclosed gateways communicate with servers hosted in the cloud based wireless communication servers 2004 or with local servers. Databases for top cap sensor data storage described in this application is found in the cloud based wireless communication servers 2004. There can be codes inside disclosed gateways that translate sensor based data to data based records. Data can be communicated from servers 2009 to gateways 2011, and the data may transition from sensor data to database records 2002 and/or to sensor data storage 2010. Disclosed analytical servers 2006 of cloud based wireless communication servers 2004 can transfer data to servers having algorithms and metrics servers 2007 and web servers 2005. Web servers 2005 disclosed in this application can transfer data to any number of client machines 2003, 2004. Described client machines 2003, 2004 can connect to any number of user interfaces 2001, 2002. Even though FIG. 20 discloses a second gateway 2013, top cap sensor modules 2014, 2016, 2019 may communicate directly with cloud-based wireless communication server 2004 and/or web server 2005. Additionally, gateways 2013 may communicate directly with web server 2005 without the need for communication through cloud-based wireless communication server 2004. Also, cloud-based wireless communication server 2009 may communicate directly with client machines 2003, 2014. Disclosed client machines 2003, 2014 can include computing environments having, among other units, a processor, a memory unit, an input/output (I/O) unit, a communication unit, a resource allocator, and a location determinator Information gathered from the sensors by the user gives useful data regarding the health and normal operating parameters of the gear rod rotator.

As shown in FIG. 20, a gear rod rotator monitoring system includes a gateway or wireless information communication device 2011, 2019. In disclosed embodiments, gateways 2011, 2019 can receive information or data from a sensor module transmitter, which may then be transmitted from the gateway 2011, 2019 to a server 2009 for data storage, analysis, or handling. Transmission or communication of data from the sensor module transmitter to gateways 2011, 2019 and from gateways 2011, 2019 to the server 2009 can be performed through mobile broadband, Wi-Fi, Bluetooth, 802.15.4, Zigbee, RF, and combinations thereof. Described servers 2005, 2006, 2009, 2010 can communicate with each other through any available RF data link module. Through transmission of data to and from top cap sensor modules 2014, 2016, 2019 disclosed gateways 2011, 2019 provide for cloud-based transmission, aggregation, and analysis of data measured by top cap sensor modules 2014, 2016, 2019 that may not be permitted in systems without a gateway 2011, 2019. Described gateways 2011, 2019 can be powered by rechargeable batteries, non-rechargeable batteries, direct powerlines, photo-voltaic cells or through other power sources, such as, for example, RF-based wireless charging. Gateways 2011, 2019 disclosed in this application also include solar-powered systems with battery backups that can last for about three days or longer depending upon available sunlight and battery capacity. Gateways 2011, 2019 disclosed in this application include a computing environment having, among other units, a processor, a memory unit, an input/output (I/O) unit, a communication unit, a resource allocator, and a location determinator.

As shown in FIG. 20, user interfaces 2001, 2002 may (a) provide users with a visualization of aggregated data from top cap sensor modules 2014, 2016, 2019, (b) provide the user with a multi-dimensional analysis of top cap, sucker rod, or down well states as a factor of time, and (c) provide users with substantially instantaneous data from multiple top cap sensor modules. For example, output obtained through user interfaces 2001, 2002 includes vibration, temperature, torque, vibration versus time, temperature versus time, torque versus time, and combinations thereof.

EXAMPLES

Some specific example embodiments of the disclosure may be illustrated by one or more of the examples provided herein.

Example 1: Comparative Gear Rotator System Specifications

In table 1, a comparative gear rod system not having a nesting region ("Comparative SGR") is compared to a gear rod system having a nesting region or locking fixture ("SGR w/ Nesting region"). Besides an over four times greater maximum output torque, the SGR w/ nesting region has a 90° lever pulls per revolution of 200 (or a rotation speed of 200 lever pulls per rod revolution), or 45° lever pulls per revolution of 400 (or a rotation speed of 400 lever pulls per rod revolution), which is greater than the Comparative SGR value of from 144-154.

TABLE 1

Comparison of Comparative SGR to SGR w/Nesting Region

| Metric | Comparative SGR | SGR w/Nesting Region |
|---|---|---|
| 90 Lever pulls per revolution | 144-154 | 200 |
| Polished rod clamp torque transmission | Friction force | Top Cap Polished Rod Clamp, Nesting Region and Direct Gear Torque-driven System |
| Maximum output torque (ft./lbs.) | 240 (depending on the polished rod load and rating of the gear teeth) | 1219 regardless of the polished rod load |
| Maximum recommended load (lbs.) | 36,500-40,000 | 40,000 |
| Polished rod sizes (in) | 1⅛-1¾ | 1⅛-1¾ |

Persons skilled in the art may make various changes in the shape, size, number, and/or arrangement of parts without departing from the scope of the instant disclosure. For example, the position and number of polished rod clamps may be varied. In some embodiments, nesting region shapes and sizes may be interchangeable. Interchangeability may allow the nesting region shape and size to be custom adjusted to engage any polished rod clamp. In addition, the size of a device and/or gear rod rotator system may be scaled up (e.g., to be used for larger well bore systems) or down (e.g., to be used for smaller well bore systems) to suit the needs and/or desires of a practitioner. Further, although described embodiments describe various cloud-based environments for processing and storing sensor data records/fields, it is appreciated that analytical servers can be implemented locally to a corporate enterprise and accordingly could be enterprise servers, and further that data storage could be provided in cloud-based data storage.

The systems described in the present application may be implemented in computer readable code stored on computer readable media associated with the respective sensor modules, which in turn may include microcontrollers, microprocessors, and/or array-based logic for executing the described sensing methods. Further, the web servers and analytical servers described in the present application are understood to be associated with program memory (computer readable media) for storing computer-based instructions for executing the analytical methods and systems described in the present embodiments.

As used herein, the term "signal" may refer to a single signal or multiple signals. The term "signals" may refer to a single signal or multiple signals. Any reference to a signal may be a reference to an attribute of the signal.

Any transmission, reception, connection, or communication may occur using any short-range (e.g., Bluetooth, Bluetooth Low Energy, near field communication, Wi-Fi Direct, etc.) or long-range communication mechanism (e.g., Wi-Fi, cellular, etc.). Additionally or alternatively, any transmission, reception, connection, or communication may occur using wired technologies. Any transmission, reception, or communication may occur directly between systems or indirectly via one or more systems such as servers.

Disclosed computing environments can be included in top cap sensor modules, cloud-based wireless communication servers, cloud-based wireless communication servers, and gateways. Computer environments described herein include, among other units, processors, memory units, input/output (110) units, communication units, resource allocators, and location determinators. As described herein, each of the processors, the memory units, the I/O units, and/or the communication units may include and/or refer to a plurality of respective units, sub-units, and/or elements. The various units may be implemented entirely in hardware, entirely in software, or in a combination of hardware and software. Some of the units may be optional. Any software described herein may be specially purposed software for performing a particular function. In some embodiments, hardware may also be specially purposed hardware for performing some particular functions. Furthermore, each of the processor, the memory unit, the I/O unit, the communication unit, and/or the other units disclosed in this application, may be operatively and/or otherwise communicatively coupled with each other using a chipset such as an intelligent chipset. The chipset may have hardware for supporting connections in the computing environment and connections made to external systems from the computing environment. While various units described in this application are presented as separate units, some of the units may be included in other units. Additionally, some of the units may be optional. Additionally, one or more units may be coupled or connected (e.g., via a wired or wireless connection) to other units. For example, the processor may be connected to one or more other units in this application.

Described processors may control any of the other units and/or functions performed by the units. Any actions described herein as being performed by a processor may be taken by the processor alone and/or by the processor in conjunction with one or more additional processors, units, and/or the like. Additionally, while only one processor may be shown in certain figures, multiple processors may be present and/or otherwise included in the computing environment. Thus, while instructions may be described as being executed by the processor, the instructions may be executed simultaneously, serially, and/or by one or multiple processors in parallel. In some embodiments, the processor may refer to any microprocessor, such as a specially purposed microprocessor. In some embodiments, the processor may refer to any type of processor, including a digital processor, an analog processor, a mixed analog-digital processor, etc.

In some embodiments, processors may be implemented as one or more computer processor (CPU) chips and/or graphical processor (GPU) chips and may include a hardware device capable of executing computer instructions. The processor may execute instructions, codes, computer programs, and/or scripts. The instructions, codes, computer programs, and/or scripts may be received from and/or stored in the memory unit, the I/O unit, the communication unit, other units, and/or the like. As described herein, any unit may be utilized to perform any methods described herein. In some embodiments, the computing environment may not be a generic computing system, but instead may include customized units designed to perform the various methods described herein.

Where the verb "may" appears, it is intended to convey an optional and/or permissive condition, but its use is not intended to suggest any lack of operability unless otherwise indicated. Where open terms such as "having" or "comprising" are used, one of ordinary skill in the art having the benefit of the instant disclosure will appreciate that the disclosed features or steps optionally may be combined with additional features or steps. Such option may not be exercised and, indeed, in some embodiments, disclosed systems, compositions, apparatuses, and/or methods may exclude any other features or steps beyond those disclosed herein. Persons skilled in the art may make various changes in the systems of the disclosure.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value+/−about 10%, depicted value+/−about 50%, depicted value+/−about 100%) and/or a range endpoint. With respect to the former, a value of 50 depicted in an example, table, and/or drawing may form the basis of a range of, for example, about 45 to about 55, about 25 to about 100, and/or about 0 to about 100. Disclosed percentages are weight percentages except where indicated otherwise.

All or a portion of a device and/or system for gear rod rotators may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure.

What is claimed is:

1. A system for determining a status of a reciprocating rod, the system comprising:

(a) a top cap configured to engage the reciprocating rod, the top cap comprising:

(i) an elongated top cap body extending along a central vertical axis, the top cap body comprising a top face, a bottom face, and an exterior perimeter surface defining an outer perimeter of the top cap body, (ii) a polished rod opening extending along the central vertical axis of the top cap body, the polished rod opening defining an interior circumferential surface of the top cap body and configured to receive the reciprocating rod, and (iii) a top cap sensor mounting port hole, the top cap sensor mounting port hole configured to receive a top cap sensor module comprising one or more sensors operable to receive feedback from the reciprocating rod, a power supply, and a sensor module transmitter configured to send a signal from the one or more sensors; and (b) a computer processor operational to receive the signal from the sensor module transmitter.

2. The system according to claim 1, wherein the top cap sensor module further comprises a location determining system for determining network location information or physical location information associated with at least one of the top cap sensor module or the top cap.

3. The system according to claim 1, wherein the computer processor comprises: a cloud based controlling system, a programmable logic controller, a feedback control system, an on-off control system, a linear control system, a fuzzy logic control system, a programmable processing unit, a memory, a random-access memory, a network interface controller, a motherboard, an input device, and an output device, and wherein the processor is configured to monitor and control a system in which the reciprocating rod is being used to extract an organic compound from a source of the organic compound.

4. The system according to claim 1, wherein the one or more sensors are selected from the group consisting of a position sensor, a temperature sensor, and a vibration sensor.

5. The system according to claim 1, wherein the top cap further comprises:

a nesting region along the top face, the nesting region configured to receive at least a portion of a polished rod clamp; and a mounting rim on the bottom face and extending outwardly from the bottom face along a longitudinal axis of the top cap body, the mounting rim comprising a mounting rim outer diameter, a mounting rim inner diameter, and a mounting rim bottom face.

6. A method for determining a vibration condition status of a reciprocating rod string at a sucker rod pump site, the method comprising:

(a) measuring vibration signals from a vibration sensor contained in a top cap of a gear rod rotator that is engaged with the reciprocating rod string, the vibration sensor operable to provide electrical output indicative of sensed vibration in the reciprocating rod string;

(b) receiving the vibration signals from the vibration sensor;

(c) transmitting the vibration signals from the vibration sensor to a computer processor to produce transmitted vibration signals; and (d) aggregating the transmitted vibration signals to produce historical vibration data; and (e) storing the historical vibration data in a web server remote from the sucker rod pump site, the historical vibration data accessible by an analytical server for data analysis and access by production and other personnel.

7. The method according to claim 6, further comprising:

placing a position sensor in the top cap of the gear rod rotator;

measuring position signals from the position sensor contained in the top cap, the position sensor operable to provide electrical output indicative of sensed position of the reciprocating rod string;

transmitting the position signals from the position sensor to a computer processor to produce transmitted position signals;

receiving with a computer processor the position signals from the position sensor;

analyzing the position signals and the vibration signals with the computer processor.

8. The method according to claim 7, further comprising indicating if the rod string is overly worn through analysis of the position signals.

9. The method according to claim 7, further comprising indicating if one of the rod string and other components associated with driving the rod string has wear through analysis of the position signals and the vibration signals.

10. The method according to claim 9, further comprising indicating wear of one of a worm gear and a worm drive shaft through the indication of wear of the one of the rod string and other components associated with driving the rod string.

11. The method according to claim 7, further comprising determining if the gear rod rotator has become inefficient at rotating the rod string through analysis of the position signals.

12. The method according to claim 7, wherein the position signals include rotational changes in the top cap.

13. The method according to claim 11, further comprising determining the positions of at least one of the top cap and the rod string using the vibration signals.

14. The method according to claim 7, further comprising measuring one of other vibration signals and other position signals from multiple other sucker rod pump sites and aggregating one of the other vibration signals and other position signals to provide analytical data that are configured to be used for the analysis of one of individual sucker rod pump sites and collective production equipment analysis.

15. A method for determining a vibration condition of a reciprocating rod string at a sucker rod pump site, the method comprising:

(a) measuring vibration signals from a vibration sensor contained in a top cap of a gear rod rotator that is engaged with the reciprocating rod string, the vibration sensor operable to provide electrical output indicative of sensed vibration in the reciprocating rod string;

(b) receiving the vibration signals from the vibration sensor;

(c) transmitting the vibration signals from the vibration sensor to a computer processor to produce transmitted vibration signals;

(d) aggregating the transmitted vibration signals to produce historical vibration data;

(e) storing the historical vibration data in a web server remote from the sucker rod pump site, the historical vibration data accessible by an analytical server for data analysis and access by production and other personnel; and (f) including a position sensor in the top cap of the gear rod rotator, the position sensor operable to provide position signals indicative of position of the rod string, whereby the vibration signals and the position signals are configured to be analyzed together.

16. The method according to claim 15, wherein analysis of the position signals and the vibration signals provides combined sensor data that indicate if the rod string is overly worn.

17. The method according to claim 15, further comprising indicating if there has been wear of one of the rod string and other components associated with driving the rod string through analysis of the position signals and the vibration signals.

18. The method according to claim 15, further comprising determining if the gear rod rotator has become inefficient at rotating the rod string through analysis of the position signals.

19. The method according to claim 15, wherein the position signals include rotational changes in the top cap.

20. The method according to claim 15, further comprising measuring one of other vibration signals and other position signals from multiple other sucker rod pump sites and aggregating the one of other vibration signals and other position signals to provide analytical data configured to be used for the analysis of one of individual sucker rod pump sites and collective production equipment analysis.

* * * * *